US010847901B1

(12) United States Patent
Ayala Vazquez et al.

(10) Patent No.: US 10,847,901 B1
(45) Date of Patent: Nov. 24, 2020

(54) ELECTRONIC DEVICE ANTENNAS HAVING ISOLATION ELEMENTS

(71) Applicant: Apple Inc., Cupertino, CA (US)

(72) Inventors: Enrique Ayala Vazquez, Watsonville, CA (US); Hongfei Hu, Cupertino, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 20 days.

(21) Appl. No.: 16/446,503

(22) Filed: Jun. 19, 2019

(51) Int. Cl.
*H01Q 21/28* (2006.01)
*H01Q 1/24* (2006.01)

(52) U.S. Cl.
CPC ..... *H01Q 21/28* (2013.01); *H01Q 1/243* (2013.01); *H01Q 1/245* (2013.01)

(58) Field of Classification Search
CPC ..... H01Q 21/28; H01Q 1/24
USPC ..... 343/702
See application file for complete search history.

(56) References Cited

U.S. PATENT DOCUMENTS

| | | | |
|---|---|---|---|
| 6,864,840 | B2 | 3/2005 | Zhu et al. |
| 9,472,846 | B2 | 10/2016 | Ng et al. |
| 10,074,890 | B2 | 9/2018 | Barnickel et al. |
| 2019/0165837 | A1* | 5/2019 | Son ..... H04B 17/102 |

FOREIGN PATENT DOCUMENTS

| | | |
|---|---|---|
| EP | 2885839 | 4/2017 |
| EP | 3041084 | 4/2019 |

OTHER PUBLICATIONS

U.S. Appl. No. 15/902,907, filed Feb. 22, 2017.

* cited by examiner

*Primary Examiner* — Andrea Lindgren Baltzell
(74) *Attorney, Agent, or Firm* — Treyz Law Group, P.C.; Michael H. Lyons

(57) ABSTRACT

An electronic device may include an antenna and peripheral conductive housing structures. A dielectric gap may divide the peripheral conductive housing structures into first and second segments. The first and second segments may be separated from the antenna ground by respective first and second slots and may be fed using respective first and second feeds. An antenna isolation element may be coupled to the antenna ground and may separate the first slot element from the second slot element. The antenna isolation element may include a metal strip having an end coupled to the antenna ground and an opposing tip that extends into the dielectric gap. The antenna isolation element may electromagnetically isolate first radio-frequency signals conveyed by the first antenna feed in a cellular midband from second radio-frequency signals conveyed by the second antenna feed in a cellular high band.

20 Claims, 10 Drawing Sheets

ELECTRONIC DEVICE ANTENNAS HAVING ISOLATION ELEMENTS

BACKGROUND

This relates to electronic devices, and more particularly, to antennas for electronic devices with wireless communications circuitry.

Electronic devices often include wireless communications circuitry. For example, cellular telephones, computers, and other devices often contain antennas and wireless transceivers for supporting wireless communications.

To satisfy consumer demand for small form factor wireless devices, manufacturers are continually striving to implement wireless communications circuitry such as antenna components using compact structures. At the same time, there is a desire for wireless devices to cover a growing number of communications bands. For example, it may be desirable for a wireless device to cover many different cellular telephone communications bands at different frequencies.

Because antennas have the potential to interfere with each other and with components in a wireless device, care must be taken when incorporating antennas into an electronic device. Moreover, care must be taken to ensure that the antennas and wireless circuitry in a device are able to exhibit satisfactory performance over the desired range of operating frequencies. In addition, it is often difficult to perform wireless communications with a satisfactory data rate (data throughput), especially as software applications performed by wireless devices become increasingly data hungry.

It would therefore be desirable to be able to provide improved wireless communications circuitry for wireless electronic devices.

SUMMARY

An electronic device may be provided with wireless circuitry and a housing having peripheral conductive housing structures. The wireless circuitry may include an antenna that includes an antenna ground and that is fed using first and second antenna feeds. A dielectric gap may divide the peripheral conductive housing structures into first and second segments. The first segment may be separated from the antenna ground by a first slot element. The second segment may be separated from the antenna ground by a second slot element. The first antenna feed may be coupled across the first slot element and the second antenna feed may be coupled across the second slot element.

The first antenna feed, first slot element, and first segment may convey first radio-frequency signals in a cellular low band, a cellular low-midband, and a cellular midband. The second antenna feed and the second slot element may concurrently convey second radio-frequency signals in a cellular high band and a cellular ultra-high band. An antenna isolation element may be coupled to the antenna ground and may separate the first slot element from the second slot element. The antenna isolation element may include a metal strip having an end coupled to the antenna ground and an opposing tip that extends into the dielectric gap (e.g., the tip may be interposed between the first and second segments of the peripheral conductive housing structures).

The antenna isolation element may electromagnetically isolate the first radio-frequency signals in the cellular midband from the second radio-frequency signals in the cellular high band. Antenna currents in the cellular high band may flow along a conductive loop path that extends around the second slot element and that includes a portion of the antenna ground, the second segment, and the metal strip. The antenna currents may flow between the second segment and the tip of the metal strip across a portion of the dielectric gap. The antenna currents may flow from the second segment to the antenna ground through the metal strip. The metal strip may form an open circuit impedance across the dielectric gap (e.g., between the tip and the first segment) in the cellular midband. The dimensions and placement of the metal strip within the dielectric gap may be selected to interpose a desired tuning capacitance on the conductive loop path (e.g., to tune the frequency response of the second slot element). When configured in this way, the antenna may concurrently convey radio-frequency signals in both the cellular midband and the cellular high band with satisfactory antenna efficiency.

DETAILED DESCRIPTION

Figure 1:
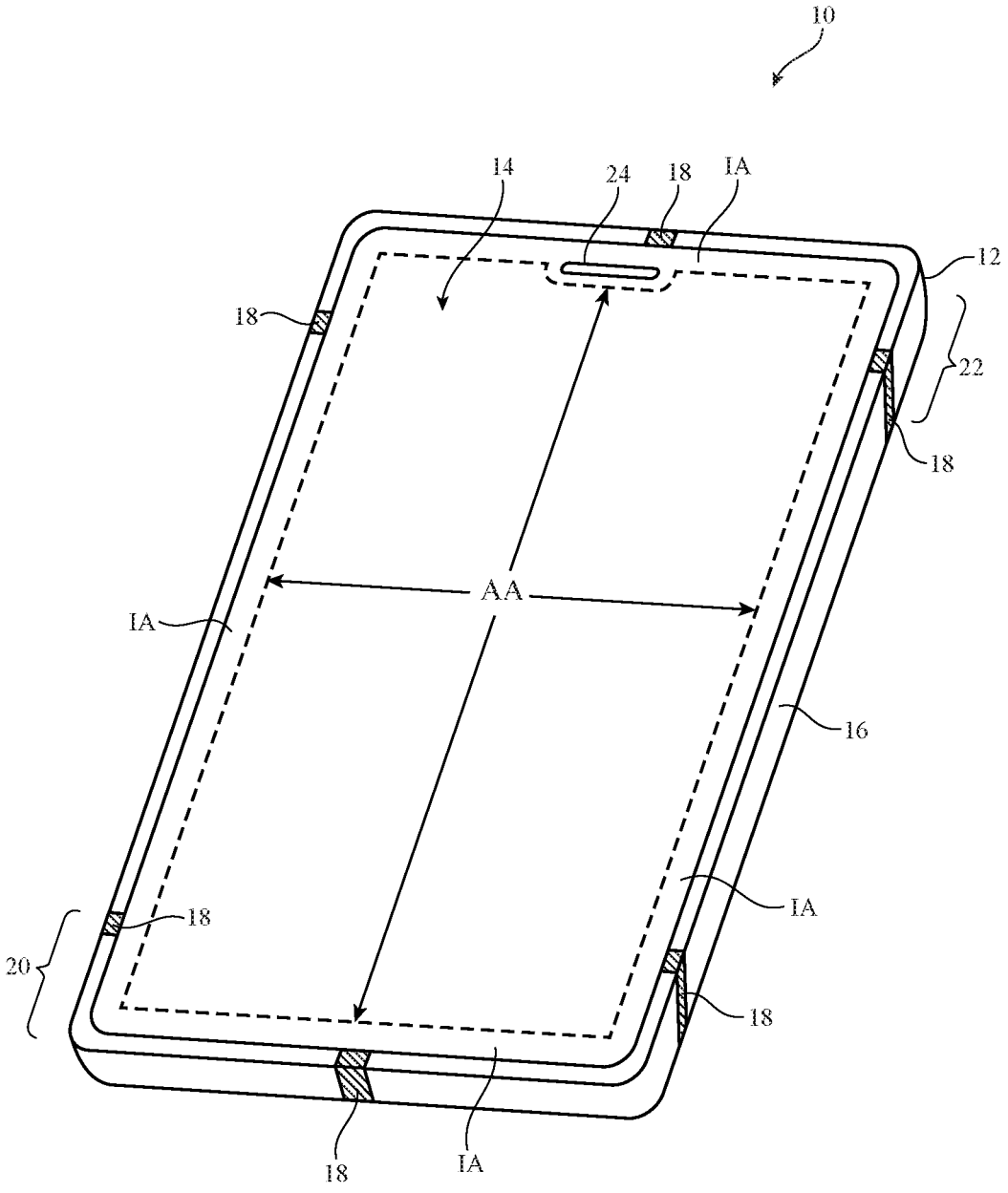
FIG. 1 is a perspective view of an illustrative electronic device with wireless communications circuitry in accordance with some embodiments.

Electronic devices such as electronic device 10 of FIG. 1 may be provided with wireless communications circuitry. The wireless communications circuitry may be used to support wireless communications in multiple wireless communications bands.

The wireless communications circuitry may include one or more antennas. The antennas of the wireless communications circuitry can include loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures.

The conductive electronic device structures may include conductive housing structures. The housing structures may include peripheral structures such as peripheral conductive structures that run around the periphery of the electronic device. The peripheral conductive structures may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures.

Gaps may be formed in the peripheral conductive structures that divide the peripheral conductive structures into peripheral segments. One or more of the segments may be used in forming one or more antennas for electronic device 10. Antennas may also be formed using an antenna ground plane and/or an antenna resonating element formed from conductive housing structures (e.g., internal and/or external structures, support plate structures, etc.).

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a rear housing wall (e.g., a planar housing wall). The rear housing wall may have slots that pass entirely through the rear housing wall and that therefore separate housing wall portions (rear housing wall portions and/or sidewall portions) of housing 12 from each other. The rear housing wall may include conductive portions and/or dielectric portions. If desired, the rear housing wall may include a planar metal layer covered by a thin layer or coating of dielectric such as glass, plastic, sapphire, or ceramic. Housing 12 (e.g., the rear housing wall, sidewalls, etc.) may also have shallow grooves that do not pass entirely through housing 12. The slots and grooves may be filled with plastic or other dielectric. If desired, portions of housing 12 that have been separated from each other (e.g., by a through slot) may be joined by internal conductive structures (e.g., sheet metal or other metal members that bridge the slot).

Display 14 may include pixels formed from light-emitting diodes (LEDs), organic LEDs (OLEDs), plasma cells, electrowetting pixels, electrophoretic pixels, liquid crystal display (LCD) components, or other suitable pixel structures. A display cover layer such as a layer of clear glass or plastic may cover the surface of display 14 or the outermost layer of display 14 may be formed from a color filter layer, thin-film transistor layer, or other display layer. If desired, buttons may pass through openings in the cover layer. The cover layer may also have other openings such as an opening for speaker port 24.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may, if desired, form sidewall structures for device 10 (e.g., by forming a metal band with vertical sidewalls, curved sidewalls, etc.).

Peripheral housing structures 16 may be formed of a conductive material such as metal and may therefore sometimes be referred to as peripheral conductive housing structures, conductive housing structures, peripheral metal structures, peripheral conductive housing sidewall structures, peripheral conductive housing sidewalls, peripheral conductive sidewalls, or a peripheral conductive housing member (as examples). Peripheral conductive housing structures 16 may be formed from a metal such as stainless steel, aluminum, or other suitable materials. One, two, three, four, five, six, or more than six separate structures may be used in forming peripheral conductive housing structures 16.

It is not necessary for peripheral conductive housing structures 16 to have a uniform cross-section. For example, the top portion of peripheral conductive housing structures 16 may, if desired, have an inwardly protruding lip that helps hold display 14 in place. The bottom portion of peripheral conductive housing structures 16 may also have an enlarged lip (e.g., in the plane of the rear surface of device 10). Peripheral conductive housing structures 16 may have substantially straight vertical sidewalls, may have sidewalls that are curved, or may have other suitable shapes. In some configurations (e.g., when peripheral conductive housing structures 16 serve as a bezel for display 14), peripheral conductive housing structures 16 may run around the lip of housing 12 (i.e., peripheral conductive housing structures 16 may cover only the edge of housing 12 that surrounds display 14 and not the rest of the sidewalls of housing 12).

If desired, housing 12 may have a conductive rear surface or wall. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a conductive rear housing wall of device 10 may be formed from a planar metal structure and portions of peripheral conductive housing structures 16 on the sides of housing 12 may be formed as flat or curved vertically extending integral metal portions of the planar metal structure. Housing structures such as these may, if desired, be machined from a block of metal and/or may include multiple metal pieces that are assembled together to form housing 12. The conductive rear wall of housing 12 may have one or more, two or more, or three or more portions. Peripheral conductive housing structures 16 and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide structures 16 and/or the conductive rear wall of housing 12 from view of the user).

Display 14 may have an array of pixels that form an active area AA that displays images for a user of device 10. An inactive border region such as inactive area IA may run along one or more of the peripheral edges of active area AA.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of member 16). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 16 and opposing conductive ground structures such as conductive portions of the rear wall of housing 12, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22), thereby narrowing the slots in regions 20 and 22.

In general, device 10 may include any suitable number of antennas (e.g., one or more, two or more, three or more, four or more, etc.). The antennas in device 10 may be located at opposing first and second ends of an elongated device housing (e.g., in regions 20 and 22 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 16 may be provided with peripheral gap structures. For example, peripheral conductive housing structures 16 may be provided with one or more gaps such as gaps 18, as shown in FIG. 1. The gaps in peripheral conductive housing structures 16 may be filled with dielectric such as polymer, ceramic, glass, air, other dielectric materials, or combinations of these materials. Gaps 18 may divide peripheral conductive housing structures 16 into one or more peripheral conductive segments. There may be, for example, two peripheral conductive segments in peripheral conductive housing structures 16 (e.g., in an arrangement with two of gaps 18), three peripheral conductive segments (e.g., in an arrangement with three of gaps 18), four peripheral conductive segments (e.g., in an arrangement with four of gaps 18), six peripheral conductive segments (e.g., in an arrangement with six gaps 18), etc. The segments of peripheral conductive housing structures 16 that are formed in this way may form parts of antennas in device 10.

If desired, openings in housing 12 such as grooves that extend partway or completely through housing 12 may extend across the width of the rear wall of housing 12 and may penetrate through the rear wall of housing 12 to divide the rear wall into different portions. These grooves may also extend into peripheral conductive housing structures 16 and may form antenna slots, gaps 18, and other structures in device 10. Polymer or other dielectric may fill these grooves and other housing openings. In some situations, housing openings that form antenna slots and other structure may be filled with a dielectric such as air.

In a typical scenario, device 10 may have one or more upper antennas and one or more lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, near-field communications, etc.

Figure 2:
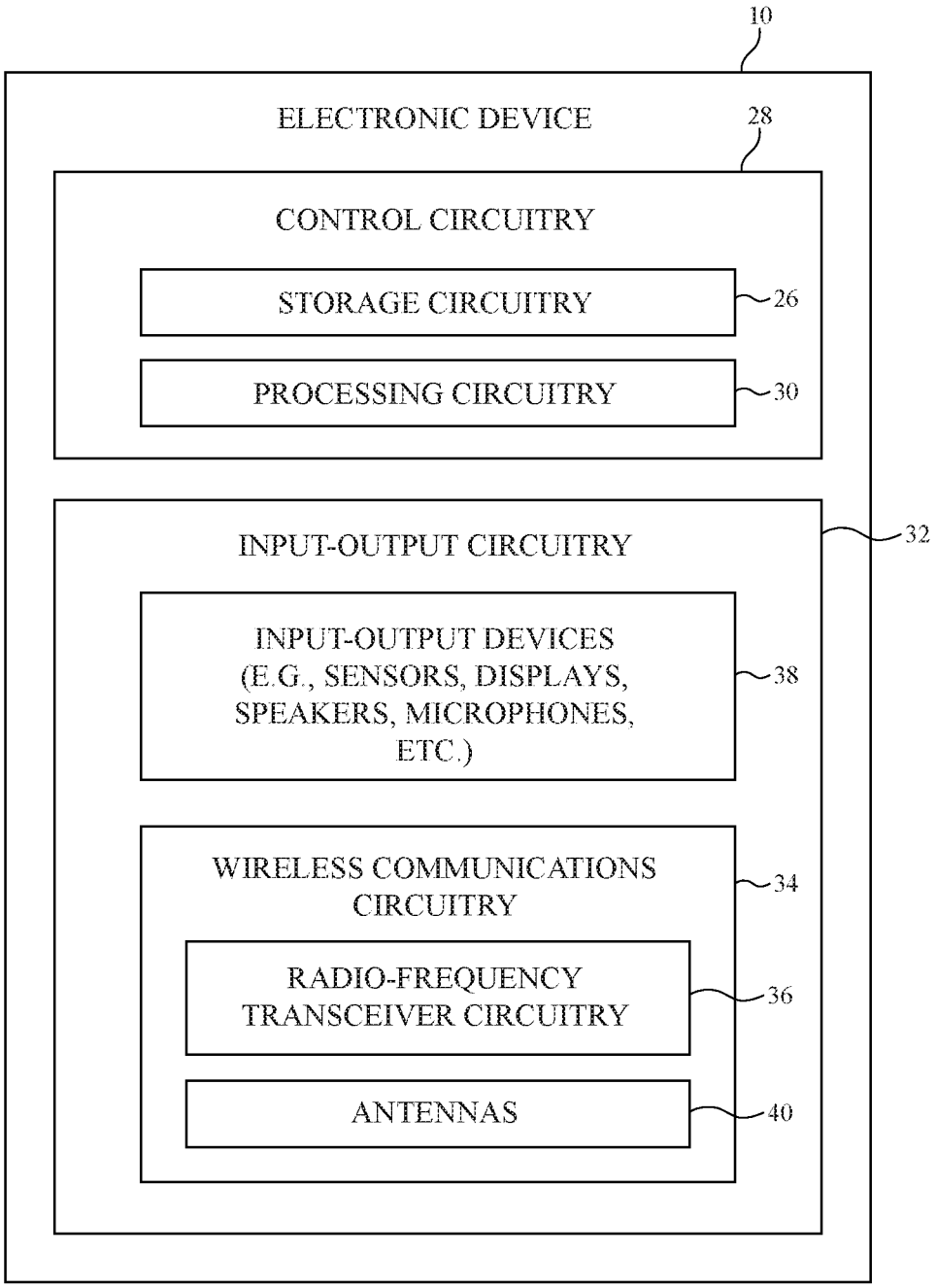
FIG. 2 is a schematic diagram of illustrative circuitry in an electronic device in accordance with some embodiments.

A schematic diagram showing illustrative components that may be used in device 10 of FIG. 1 is shown in FIG. 2. As shown in FIG. 2, device 10 may include control circuitry 28. Control circuitry 28 may include storage such as storage circuitry 26. Storage circuitry 26 may include hard disk drive storage, nonvolatile memory (e.g., flash memory or other electrically-programmable-read-only memory configured to form a solid-state drive), volatile memory (e.g., static or dynamic random-access-memory), etc.

Control circuitry 28 may include processing circuitry such as processing circuitry 30. Processing circuitry 30 may be used to control the operation of device 10. Processing circuitry 30 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 26 (e.g., storage circuitry 26 may include non-transitory (tangible) computer readable storage media that stores the software code). The software code may sometimes be referred to as program instructions, software, data, instructions, or code. Software code stored on storage circuitry 26 may be executed by processing circuitry 30.

Control circuitry 28 may be used to run software on device 10 such as satellite navigation applications, internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as Wi-Fi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols (e.g., global positioning system (GPS) protocols, global navigation satellite system (GLONASS) protocols, etc.), or any other desired communications protocols. Each communications protocol may be associated with a corresponding radio access technology (RAT) that specifies the physical connection methodology used in implementing the protocol.

Device 10 may include input-output circuitry 32. Input-output circuitry 32 may include input-output devices 38. Input-output devices 38 may be used to allow data to be supplied to device 10 and to allow data to be provided from device 10 to external devices. Input-output devices 38 may include user interface devices, data port devices, and other input-output components. For example, input-output devices 38 may include touch screens, displays without touch sensor capabilities, buttons, joysticks, scrolling wheels, touch pads, key pads, keyboards, microphones, cameras, buttons, speakers, status indicators, light sources, audio jacks and other audio port components, digital data port devices, light sensors, position and orientation sensors (e.g., sensors such as accelerometers, gyroscopes, and compasses), capacitance sensors, proximity sensors (e.g., capacitive proximity sensors, light-based proximity sensors, etc.), fingerprint sensors, etc.

Input-output circuitry 32 may include wireless communications circuitry such as wireless communications circuitry 34 (sometimes referred to herein as wireless circuitry 34) for wirelessly conveying radio-frequency signals. While control circuitry 28 is shown separately from wireless communications circuitry 34 in the example of FIG. 2 for the sake of clarity, wireless communications circuitry 34 may include processing circuitry that forms a part of processing circuitry 30 and/or storage circuitry that forms a part of storage circuitry 26 of control circuitry 28 (e.g., portions of control circuitry 28 may be implemented on wireless communications circuitry 34). As an example, control circuitry 28 (e.g., processing circuitry 30) may include baseband processor circuitry or other control components that form a part of wireless communications circuitry 34.

Wireless communications circuitry 34 may include radio-frequency (RF) transceiver circuitry formed from one or more integrated circuits, power amplifier circuitry, low-noise input amplifiers, passive RF components, one or more antennas, transmission lines, and other circuitry for handling RF wireless signals. Wireless signals can also be sent using light (e.g., using infrared communications).

Wireless communications circuitry 34 may include radio-frequency transceiver circuitry 36 for handling transmission and/or reception of radio-frequency signals in various radio-frequency communications bands. For example, radio-frequency transceiver circuitry 36 may handle 2.4 GHz and 5 GHz bands for Wi-Fi® (IEEE 802.11) communications or communications in other wireless local area network (WLAN) bands. Radio-frequency transceiver circuitry 36 may handle the 2.4 GHz Bluetooth® communications band or other wireless personal area network (WPAN) bands. Radio-frequency transceiver circuitry 36 may include cellular telephone transceiver circuitry for handling wireless communications in frequency ranges such as a cellular low band (LB) from 600 to 960 MHz, a cellular low-midband (LMB) from 1410 to 1510 MHz, a cellular midband (MB) from 1710 to 2170 MHz, a cellular high band (HB) from 2300 to 2700 MHz, a cellular ultra-high band (UHB) from 3300 to 5000 MHz, or other communications bands between 600 MHz and 5000 MHz or other suitable frequencies (as examples).

In one suitable arrangement, radio-frequency transceiver circuitry 36 may handle 4G frequency bands between 3300 and 5000 MHz such as Long Term Evolution (LTE) bands B42 (e.g., 3400 MHz-3600 MHz) and B48 (e.g., 3500-3700) as well as 5G frequency bands (e.g., 5G NR bands) below 6 GHz such as 5G bands N77 (e.g., 3300-4200 MHz), N78 (e.g., 3300-3800 MHz), and N79 (e.g., 4400-5000 MHz). If desired, radio-frequency transceiver circuitry 36 may include a first transceiver integrated circuit (chip) for handling 4G communications and a second transceiver integrated circuit (chip) for handling 5G communications (e.g., the first transceiver integrated circuit may operate under a 4G radio access technology whereas the second transceiver integrated circuit may operate under a 5G radio access technology). Each transceiver integrated circuit may be coupled to one or of the same antennas over one or more radio-frequency transmission lines. For example, each transceiver integrated circuit may be coupled to the same antenna feeds or different antenna feeds of the same antenna via the same radio-frequency transmission line or via separate radio-frequency transmission lines. Filter circuitry (e.g., duplexer circuitry, diplexer circuitry, low pass filter circuitry, high pass filter circuitry, band pass filter circuitry, band stop filter circuitry, etc.), switching circuitry, multiplexing circuitry, or any other desired circuitry may be used to isolate radio-frequency signals conveyed by the first and second transceiver integrated circuits over the same antennas or antenna feeds (e.g., filtering circuitry or multiplexing circuitry may be interposed on a radio-frequency transmission line shared by the first and second transceiver integrated circuits).

Radio-frequency transceiver circuitry 36 may handle voice data and non-voice data. Radio-frequency transceiver circuitry 36 may include circuitry for other short-range and long-range wireless links if desired. For example, radio-frequency transceiver circuitry 36 may include 60 GHz transceiver circuitry (e.g., millimeter wave transceiver circuitry), circuitry for receiving television and radio signals, paging system transceivers, near field communications (NFC) circuitry, etc. Radio-frequency transceiver circuitry 36 may include global positioning system (GPS) receiver circuitry for receiving GPS signals at 1575 MHz or for handling other satellite positioning data. In Wi-Fi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be formed using any suitable antenna types. For example, antennas 40 may include antennas with resonating elements that are formed from loop antenna structures, patch antenna structures, inverted-F antenna structures, slot antenna structures, planar inverted-F antenna structures, helical antenna structures, dipole antenna structures, monopole antenna structures, hybrids of these designs, etc. Different types of antennas may be used for different bands and combinations of bands. For example, one type of antenna may be used in forming a local wireless link antenna and another type of antenna may be used in forming a remote wireless link antenna.

Figure 3:
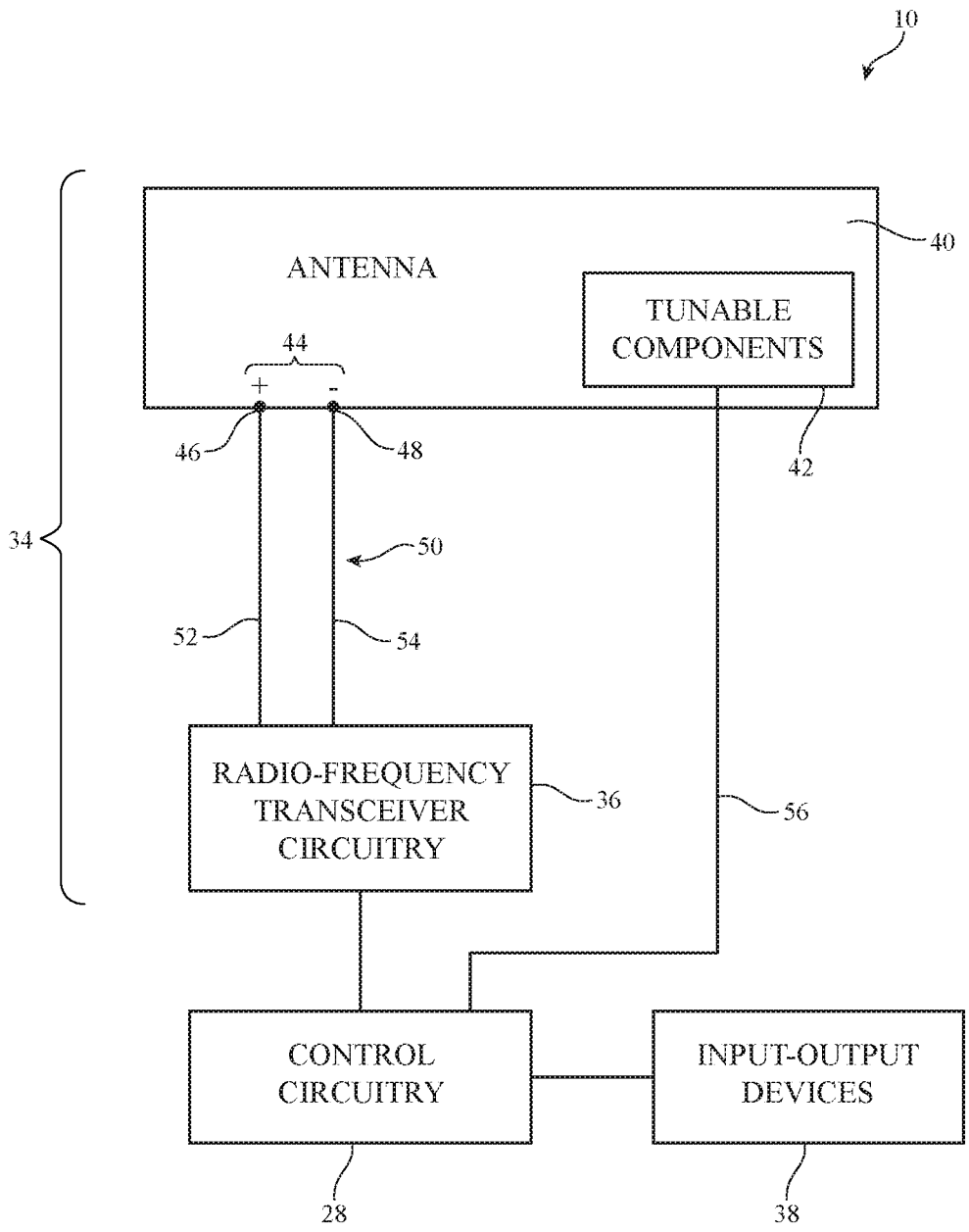
FIG. 3 is a schematic diagram of illustrative wireless communications circuitry in accordance with some embodiments.

As shown in FIG. 3, radio-frequency transceiver circuitry 36 in wireless communications circuitry 34 may be coupled to antenna structures such as a given antenna 40 using paths such as path 50. Wireless communications circuitry 34 may be coupled to control circuitry 28. Control circuitry 28 may be coupled to input-output devices 38. Input-output devices 38 may supply output from device 10 and may receive input from sources that are external to device 10.

To provide antenna structures such as antenna 40 with the ability to cover communications frequencies of interest, antenna 40 may be provided with circuitry such as filter circuitry (e.g., one or more passive filters and/or one or more tunable filter circuits). Discrete components such as capacitors, inductors, and resistors may be incorporated into the filter circuitry. Capacitive structures, inductive structures, and resistive structures may also be formed from patterned metal structures (e.g., part of an antenna). If desired, antenna 40 may be provided with adjustable circuits such as tunable components 42 to tune the antenna over communications (frequency) bands of interest. Tunable components 42 may be part of a tunable filter or tunable impedance matching network, may be part of an antenna resonating element, may span a gap between an antenna resonating element and antenna ground, etc.

Tunable components 42 may include tunable inductors, tunable capacitors, or other tunable components. Tunable components such as these may be based on switches and networks of fixed components, distributed metal structures that produce associated distributed capacitances and inductances, variable solid-state devices for producing variable capacitance and inductance values, tunable filters, or other suitable tunable structures. During operation of device 10, control circuitry 28 may issue control signals on one or more paths such as path 56 that adjust inductance values, capacitance values, or other parameters associated with tunable components 42, thereby tuning antenna 40 to cover desired communications bands. Antenna tuning components that are used to adjust the frequency response of antenna 40 such as tunable components 42 may sometimes be referred to herein as antenna tuning components, tuning components, antenna tuning elements, tuning elements, adjustable tuning components, adjustable tuning elements, or adjustable components.

Path 50 may include one or more transmission lines. As an example, path 50 of FIG. 3 may be a transmission line having a positive signal conductor such as signal conductor 52 and a ground signal conductor such as ground conductor 54. Path 50 may sometimes be referred to herein as transmission line 50 or radio-frequency transmission line 50.

Transmission line 50 may, for example, include a coaxial cable transmission line (e.g., ground conductor 54 may be implemented as a grounded conductive braid surrounding signal conductor 52 along its length), a stripline transmission line, a microstrip transmission line, coaxial probes realized by a metalized via, an edge-coupled microstrip transmission line, an edge-coupled stripline transmission line, a waveguide structure (e.g., a coplanar waveguide or grounded coplanar waveguide), combinations of these types of transmission lines and/or other transmission line structures, etc.

Transmission lines in device 10 such as transmission line 50 may be integrated into rigid and/or flexible printed circuit boards. In one suitable arrangement, transmission lines such as transmission line 50 may also include transmission line conductors (e.g., signal conductors 52 and ground conductors 54) integrated within multilayer laminated structures (e.g., layers of a conductive material such as copper and a dielectric material such as a resin that are laminated together without intervening adhesive). The multilayer laminated structures may, if desired, be folded or bent in multiple dimensions (e.g., two or three dimensions) and may maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

A matching network (e.g., an adjustable matching network formed using tunable components 42) may include components such as inductors, resistors, and capacitors used in matching the impedance of antenna 40 to the impedance of transmission line 50. Matching network components may be provided as discrete components (e.g., surface mount technology components) or may be formed from housing structures, printed circuit board structures, traces on plastic supports, etc. Components such as these may also be used in forming filter circuitry in antenna 40 and may be tunable and/or fixed components.

Transmission line 50 may be coupled to antenna feed structures associated with antenna 40. As an example, antenna 40 may form an inverted-F antenna, a slot antenna, a hybrid inverted-F slot antenna or other antenna having an antenna feed 44 with a positive antenna feed terminal such as positive antenna feed terminal 46 and a ground antenna feed terminal such as ground antenna feed terminal 48. Signal conductor 52 may be coupled to positive antenna feed terminal 46 and ground conductor 54 may be coupled to ground antenna feed terminal 48. Other types of antenna feed arrangements may be used if desired. For example, antenna 40 may be fed using multiple feeds each coupled to a respective port of radio-frequency transceiver circuitry 36 over a corresponding transmission line. If desired, signal conductor 52 may be coupled to multiple locations on antenna 40 (e.g., antenna 40 may include multiple positive antenna feed terminals coupled to signal conductor 52 of the same transmission line 50). Switches may be interposed on the signal conductor between radio-frequency transceiver circuitry 36 and the positive antenna feed terminals if desired (e.g., to selectively activate one or more positive antenna feed terminals at any given time). The illustrative feeding configuration of FIG. 3 is merely illustrative.

Control circuitry 28 may use information from a proximity sensor, wireless performance metric data such as received signal strength information, device orientation information from an orientation sensor, device motion data from an accelerometer or other motion detecting sensor, information about a usage scenario of device 10, information about whether audio is being played through speaker port 24 (FIG. 1), information from one or more antenna impedance sensors, information on desired frequency bands to use for communications, and/or other information in determining when antenna 40 is being affected by the presence of nearby external objects or is otherwise in need of tuning. In response, control circuitry 28 may adjust an adjustable inductor, adjustable capacitor, switch, or other tunable components such as tunable components 42 to ensure that antenna 40 operates as desired. Adjustments to tunable components 42 may also be made to extend the frequency coverage of antenna 40 (e.g., to cover desired communications bands that extend over a range of frequencies larger than antenna 40 would cover without tuning).

Antenna 40 may include antenna resonating element structures (sometimes referred to herein as radiating element structures), antenna ground plane structures (sometimes referred to herein as ground plane structures, ground structures, or antenna ground structures), an antenna feed such as feed 44, and other components (e.g., tunable components 42). Antenna 40 may be configured to form any suitable type of antenna. With one suitable arrangement, which is sometimes described herein as an example, antenna 40 is used to implement a hybrid inverted-F-slot antenna that includes both inverted-F and slot antenna resonating elements.

Figure 4:
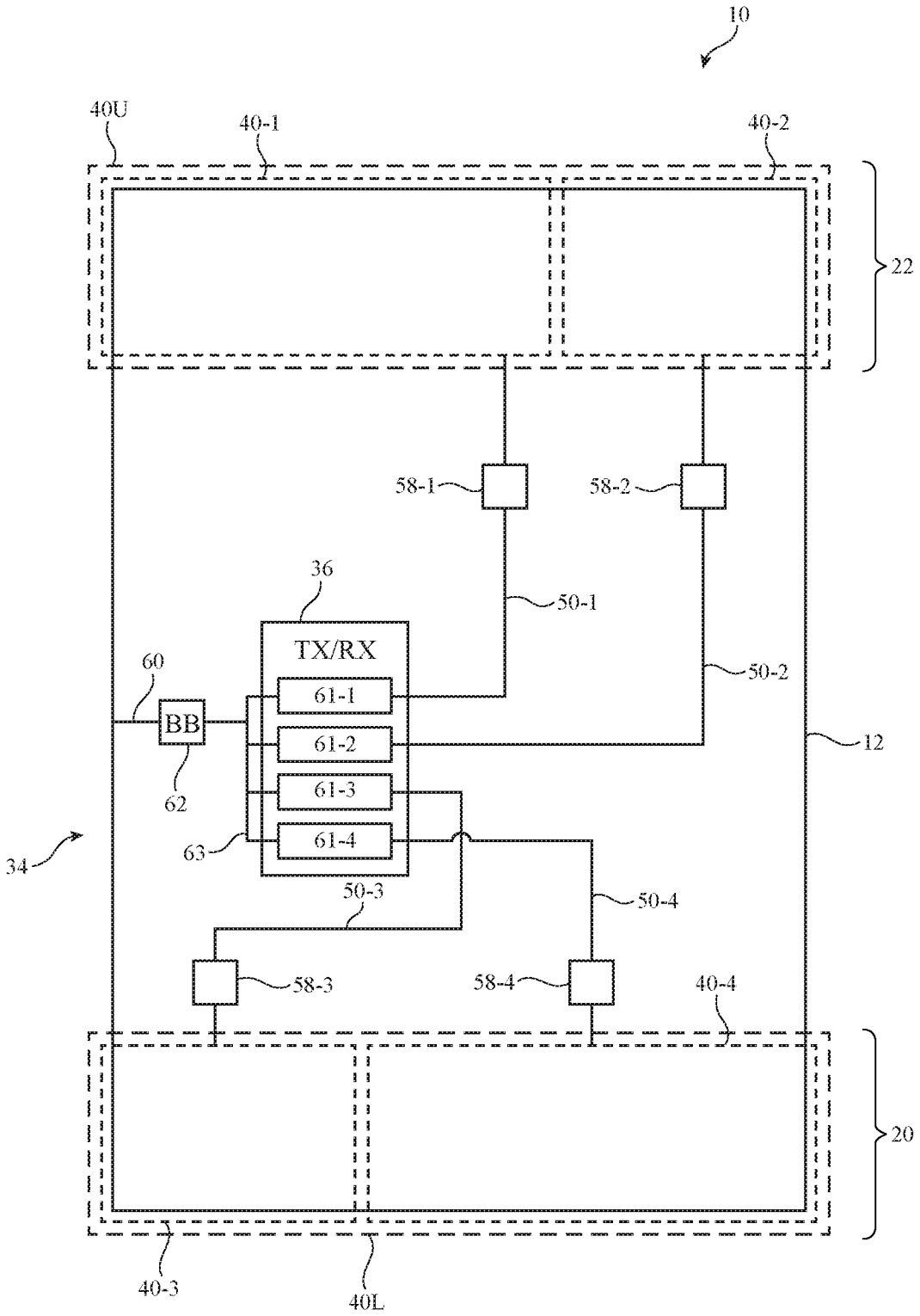
FIG. 4 is a diagram of illustrative wireless circuitry including multiple antennas for performing multiple-input and multiple-output (MIMO) communications in accordance with some embodiments.

If desired, multiple antennas 40 may be formed in device 10. Each antenna 40 may be coupled to transceiver circuitry such as radio-frequency transceiver circuitry 36 over respective transmission lines such as transmission line 50. If desired, two or more antennas 40 may share the same transmission line 50. FIG. 4 is a diagram showing how device 10 may include multiple antennas 40 for performing wireless communications.

As shown in FIG. 4, device 10 may include two or more antennas 40 such as a first antenna 40-1, a second antenna 40-2, a third antenna 40-3, and a fourth antenna 40-4. Antennas 40 may be provided at different locations within housing 12 of device 10. For example, antennas 40-1 and 40-2 may be formed within region 22 at a first (upper) end of housing 12 whereas antennas 40-3 and 40-4 are formed within region 20 at an opposing second (lower) end of housing 12. In the example of FIG. 4, housing 12 has a rectangular periphery (e.g., a periphery having four corners) and each antenna 40 is formed at a respective corner of housing 12. This example is merely illustrative and, in general, antennas 40 may be formed at any desired locations within housing 12.

Wireless communications circuitry 34 may include input-output ports such as port 60 for interfacing with digital data circuits in control circuitry (e.g., control circuitry 28 of FIG. 3). Wireless communications circuitry 34 may include baseband circuitry such as baseband (BB) processor 62 and radio-frequency transceiver circuitry such as radio-frequency transceiver circuitry 36.

Port 60 may receive digital data from control circuitry that is to be transmitted by radio-frequency transceiver circuitry 36. Incoming data that has been received by radio-frequency transceiver circuitry 36 and baseband processor 62 may be supplied to control circuitry via port 60.

Radio-frequency transceiver circuitry 36 may include one or more transmitters and one or more receivers. For example, radio-frequency transceiver circuitry 36 may include multiple remote wireless transceivers 61 such as a first transceiver 61-1, a second transceiver 61-2, a third transceiver 61-3, and a fourth transceiver 61-4 (e.g., transceiver circuits for handling voice and non-voice cellular telephone communications in cellular telephone communications bands). Each transceiver 61 may be coupled to a respective antenna 40 over a corresponding transmission line 50 (e.g., a first transmission line 50-1, a second transmission line 50-2, a third transmission line 50-3, and a fourth transmission line 50-4). For example, first transceiver 61-1 may be coupled to antenna 40-1 over transmission line 50-1, second transceiver 61-2 may be coupled to antenna 40-2 over transmission line 50-2, third transceiver 61-3 may be coupled to antenna 40-3 over transmission line 50-3, and fourth transceiver 61-4 may be coupled to antenna 40-4 over transmission line 50-4.

Radio-frequency front end circuits 58 may be interposed on each transmission line 50 (e.g., a first front end circuit 58-1 may be interposed on transmission line 50-1, a second front end circuit 58-2 may be interposed on transmission line 50-2, a third front end circuit 58-3 may be interposed on transmission line 50-3, etc.). Front end circuits 58 may each include switching circuitry, filter circuitry (e.g., duplexer and/or diplexer circuitry, notch filter circuitry, low pass filter circuitry, high pass filter circuitry, bandpass filter circuitry, etc.), impedance matching circuitry for matching the impedance of transmission lines 50 to the corresponding antenna 40, networks of active and/or passive components such as tunable components 42 of FIG. 3, radio-frequency coupler circuitry for gathering antenna impedance measurements, amplifier circuitry (e.g., low noise amplifiers and/or power amplifiers) or any other desired radio-frequency circuitry. If desired, front end circuits 58 may include switching circuitry that is configured to selectively couple antennas 40-1, 40-2, 40-3, and 40-4 to different respective transceivers 61-1, 61-2, 61-3, and 61-4 (e.g., so that each antenna can handle communications for different transceivers 61 over time based on the state of the switching circuits in front end circuits 58).

If desired, front end circuits 58 may include filtering circuitry (e.g., duplexers and/or diplexers) that allow the corresponding antenna 40 to transmit and receive radio-frequency signals at the same time (e.g., using a frequency domain duplexing (FDD) scheme). Antennas 40-1, 40-2, 40-3, and 40-4 may transmit and/or receive radio-frequency signals in respective time slots or two or more of antennas 40-1, 40-2, 40-3, and 40-4 may transmit and/or receive radio-frequency signals concurrently. In general, any desired combination of transceivers 61-1, 61-2, 61-3, and 61-4 may transmit and/or receive radio-frequency signals using the corresponding antenna 40 at a given time. In one suitable arrangement, each of transceivers 61-1, 61-2, 61-3, and 61-4 may receive radio-frequency signals while a given one of transceivers 61-1, 61-2, 61-3, and 61-4 transmits radio-frequency signals at a given time.

Amplifier circuitry such as one or more power amplifiers may be interposed on transmission lines 50 and/or formed within radio-frequency transceiver circuitry 36 for amplifying radio-frequency signals output by transceivers 61 prior to transmission over antennas 40. Amplifier circuitry such as one or more low noise amplifiers may be interposed on transmission lines 50 and/or formed within radio-frequency transceiver circuitry 36 for amplifying radio-frequency signals received by antennas 40 prior to conveying the received signals to transceivers 61.

In the example of FIG. 4, separate front end circuits 58 are formed on each transmission line 50. This is merely illustrative. If desired, two or more transmission lines 50 may share the same front end circuits 58 (e.g., front end circuits 58 may be formed on the same substrate, module, or integrated circuit).

Each of transceivers 61 may, for example, include circuitry for converting baseband signals received from baseband processor 62 over paths 63 into corresponding radio-frequency signals. For example, transceivers 61 may each include mixer circuitry for up-converting the baseband signals to radio-frequencies prior to transmission over antennas 40. Transceivers 61 may include digital to analog converter (DAC) and/or analog to digital converter (ADC) circuitry for converting signals between digital and analog domains. Each of transceivers 61 may include circuitry for converting radio-frequency signals received from antennas 40 over transmission lines 50 into corresponding baseband signals. For example, transceivers 61 may each include mixer circuitry for down-converting the radio-frequency signals to baseband frequencies prior to conveying the baseband signals to baseband processor 62 over paths 63.

Each transceiver 61 may be formed on the same substrate, integrated circuit, or module (e.g., radio-frequency transceiver circuitry 36 may be a transceiver module having a substrate or integrated circuit on which each of transceivers 61 is formed) or two or more transceivers 61 may be formed on separate substrates, integrated circuits, or modules. Baseband processor 62 and front end circuits 58 may be formed on the same substrate, integrated circuit, or module as transceivers 61 or may be formed on separate substrates, integrated circuits, or modules from transceivers 61. In another suitable arrangement, radio-frequency transceiver circuitry 36 may include a single transceiver 61 having four ports, each of which is coupled to a respective transmission line 50, if desired. Each transceiver 61 may include transmitter and receiver circuitry for both transmitting and receiving radio-frequency signals. In another suitable arrangement, one or more transceivers 61 may perform only signal transmission or signal reception (e.g., one or more of transceivers 61 may be a dedicated transmitter or dedicated receiver).

In the example of FIG. 4, antennas 40-1 and 40-4 may occupy a larger space (e.g., a larger area or volume within device 10) than antennas 40-2 and 40-3. This may allow antennas 40-1 and 40-4 to support communications at longer wavelengths (i.e., lower frequencies) than antennas 40-2 and 40-3. This is merely illustrative and, if desired, each of antennas 40-1, 40-2, 40-3, and 40-4 may occupy the same volume or may occupy different volumes. Antennas 40-1, 40-2, 40-3, and 40-4 may be configured to convey radio-frequency signals in at least one common frequency band. If desired, one or more of antennas 40-1, 40-2, 40-3, and 40-4 may handle radio-frequency signals in at least one frequency band that is not covered by one or more of the other antennas in device 10.

If desired, each antenna 40 and each transceiver 61 may handle radio-frequency communications in multiple frequency bands (e.g., multiple cellular telephone communications bands). For example, transceiver 61-1, antenna 40-1, transceiver 61-4, and antenna 40-4, may handle radio-frequency signals in a first frequency band such as a cellular low band between 600 and 960 MHz, a second frequency band such as a cellular low-midband between 1410 and 1510 MHz, a third frequency band such as a cellular midband between 1700 and 2200 MHz, a fourth frequency band such as a cellular high band between 2300 and 2700 MHz, and/or a fifth frequency band such as a cellular ultra-high band between 3300 and 5000 MHz. Transceiver 61-2, antenna 40-2, transceiver 61-3, and antenna 40-3 may handle radio-frequency signals in some or all of these bands (e.g., in scenarios where the volume of antennas 40-3 and 40-2 is large enough to support frequencies in the low band).

The example of FIG. 4 is merely illustrative. In general, antennas 40 may cover any desired frequency bands. Housing 12 may have any desired shape. Antennas 40 may be formed at any desired locations within housing 12. Forming each of antennas 40-1 through 40-4 at different corners of housing 12 may, for example, maximize the multi-path propagation of wireless data conveyed by antennas 40 to optimize overall data throughput for wireless communications circuitry 34.

When operating using a single antenna 40, a single stream of wireless data may be conveyed between device 10 and external communications equipment (e.g., one or more other wireless devices such as wireless base stations, access points, cellular telephones, computers, etc.). This may impose an upper limit on the data rate (data throughput) obtainable by wireless communications circuitry 34 in communicating with the external communications equipment. As software applications and other device operations increase in complexity over time, the amount of data that needs to be conveyed between device 10 and the external communications equipment typically increases, such that a single antenna 40 may not be capable of providing sufficient data throughput for handling the desired device operations.

In order to increase the overall data throughput of wireless communications circuitry 34, multiple antennas 40 may be operated using a multiple-input and multiple-output (MIMO) scheme. When operating using a MIMO scheme, two or more antennas 40 on device 10 may be used to convey multiple independent streams of wireless data at the same frequency. This may significantly increase the overall data throughput between device 10 and the external communications equipment relative to scenarios where only a single antenna 40 is used. In general, the greater the number of antennas 40 that are used for conveying wireless data under the MIMO scheme, the greater the overall throughput of wireless communications circuitry 34.

In order to perform wireless communications under a MIMO scheme, antennas 40 need to convey data at the same frequencies. If desired, wireless communications circuitry 34 may perform so-called two-stream (2×) MIMO operations (sometimes referred to herein as 2×MIMO communications or communications using a 2×MIMO scheme) in which two antennas 40 are used to convey two independent streams of radio-frequency signals at the same frequency. Wireless communications circuitry 34 may perform so-called four-stream (4×) MIMO operations (sometimes referred to herein as 4×MIMO communications or communications using a 4×MIMO scheme) in which four antennas 40 are used to convey four independent streams of radio-frequency signals at the same frequency. Performing 4×MIMO operations may support higher overall data throughput than 2×MIMO operations because 4×MIMO operations involve four independent wireless data streams whereas 2×MIMO operations involve only two independent wireless data streams. If desired, antennas 40-1, 40-2, 40-3, and 40-4 may perform 2×MIMO operations in some frequency bands and may perform 4×MIMO operations in other frequency bands (e.g., depending on which bands are handled by which antennas). Antennas 40-1, 40-2, 40-3, and 40-4 may perform 2×MIMO operations in some bands concurrently with performing 4×MIMO operations in other bands, for example.

As one example, antennas 40-1 and 40-4 (and the corresponding transceivers 61-1 and 61-4) may perform 2×MIMO operations by conveying radio-frequency signals at the same frequency in a cellular low band between 600 MHz and 960 MHz. At the same time, antennas 40-1, 40-2, 40-3, and 40-4 may collectively perform 4×MIMO operations by conveying radio-frequency signals at the same frequency in a cellular midband between 1700 and 2200 MHz, at the same frequency in a cellular high band (HB) between 2300 and 2700 MHz, and/or at the same frequency in a cellular ultra-high band (UHB) between 3300 and 5000 MHz (e.g., antennas 40-1 and 40-4 may perform 2×MIMO operations in the low band concurrently with performing 4×MIMO operations in the midband, high band, and/or ultra-high band). This example is merely illustrative and, in general, any desired number of antennas may be used to perform any desired MIMO operations in any desired frequency bands.

If desired, antennas 40-1 and 40-2 may include switching circuitry that is adjusted by control circuitry (e.g., control circuitry 28 of FIG. 3). Control circuitry 28 may control the switching circuitry in antennas 40-1 and 40-2 to configure antenna structures in antennas 40-1 and 40-2 to form a single antenna 40U in region 22 of device 10. Similarly, antennas 40-3 and 40-4 may include switching circuitry that is adjusted by control circuitry 28. Control circuitry 28 may control the switching circuitry in antennas 40-3 and 40-4 to form a single antenna 40L (e.g., an antenna 40L that includes antenna structures from antennas 40-3 and 40-4) in region 20 of device 10. Antenna 40U may, for example, be formed at an upper end of housing 12 and may therefore sometimes be referred to herein as upper antenna 40U. Antenna 40L may be formed at an opposing lower end of housing 12 and may therefore sometimes be referred to herein as lower antenna 40L. When antennas 40-1 and 40-2 are configured to form upper antenna 40U and antennas 40-3 and 40-4 are configured to form lower antenna 40L, wireless communications circuitry 34 may perform 2×MIMO operations using antennas 40U and 40L in any desired frequency bands. If desired, control circuitry 28 may toggle the switching circuitry over time to switch wireless communications circuitry 34 between a first mode in which antennas 40-1, 40-2, 40-3, and 40-4 perform 2×MIMO operations in any desired frequency bands and 4×MIMO operations in any desired frequency bands and a second mode in which antennas 40-1, 40-2, 40-3, and 40-4 are configured to form antennas 40U and 40L that perform 2×MIMO operations in any desired frequency bands.

If desired, wireless communications circuitry 34 may convey wireless data with multiple antennas on one or more external devices (e.g., multiple wireless base stations) in a scheme sometimes referred to as carrier aggregation. When operating using a carrier aggregation scheme, the same antenna 40 may convey radio-frequency signals with multiple antennas (e.g., antennas on different wireless base stations) at different respective frequencies (sometimes referred to herein as carrier frequencies, channels, carrier channels, or carriers). For example, antenna 40-1 may receive radio-frequency signals from a first wireless base station at a first frequency, from a second wireless base station at a second frequency, and a from a third base station at a third frequency. The received signals at different frequencies may be simultaneously processed (e.g., by transceiver 61-1) to increase the communications bandwidth of transceiver 61-1, thereby increasing the data rate of transceiver 61-1. Similarly, antennas 40-1, 40-2, 40-3, and 40-4 may perform carrier aggregation at two, three, or more than three frequencies within any desired frequency bands. This may serve to further increase the overall data throughput of wireless communications circuitry 34 relative to scenarios where no carrier aggregation is performed. For example, the data throughput of wireless communications circuitry 34 may increase for each carrier frequency that is used (e.g., for each wireless base station that communicates with each of antennas 40-1, 40-2, 40-3, and 40-4).

By performing communications using both a MIMO scheme and a carrier aggregation scheme, the data throughput of wireless communications circuitry 34 may be even greater than in scenarios where either a MIMO scheme or a carrier aggregation scheme is used. The data throughput of wireless communications circuitry 34 may, for example, increase for each carrier frequency that is used by antennas 40 (e.g., each carrier frequency may contribute 40 megabits per second (Mb/s) or some other throughput to the total throughput of wireless communications circuitry 34). The example of FIG. 4 is merely illustrative. If desired, antennas 40 may cover any desired number of frequency bands at any desired frequencies. More than four antennas 40 or fewer than four antennas 40 may perform MIMO and/or carrier aggregation operations at non-near-field communications frequencies if desired.

Antennas 40 may include slot antenna structures, inverted-F antenna structures (e.g., planar and non-planar inverted-F antenna structures), loop antenna structures, combinations of these, or other antenna structures. An illustrative inverted-F antenna structure is shown in FIG. 5.

Figure 5:
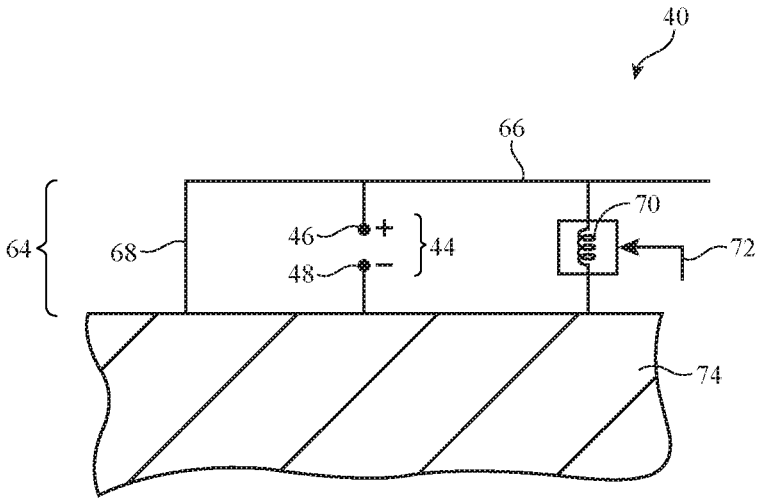
FIG. 5 is a schematic diagram of an illustrative inverted-F antenna in accordance with some embodiments.

When using an inverted-F antenna structure as shown in FIG. 5, antenna 40 may include an antenna resonating element 64 (sometimes referred to herein as antenna radiating element 64) and antenna ground 74 (sometimes referred to herein as ground plane 74 or ground 74). Antenna resonating element 64 may have a main resonating element arm such as resonating element arm 66. The length of resonating element arm 66 may be selected so that antenna 40 resonates at desired operating frequencies. For example, the length of resonating element arm 66 (or a branch of resonating element arm 66) may be approximately one-quarter of the wavelength corresponding to a desired operating frequency for antenna 40. Antenna 40 may also exhibit resonances at harmonic frequencies. If desired, slot antenna structures or other antenna structures may be incorporated into an inverted-F antenna such as antenna 40 of FIG. 5 (e.g., to enhance antenna response in one or more communications bands).

Resonating element arm 66 may be coupled to antenna ground 74 by return path 68. Antenna feed 44 may include positive antenna feed terminal 46 and ground antenna feed terminal 48 and may run parallel to return path 68 between resonating element arm 66 and antenna ground 74. If desired, antenna 40 may have more than one resonating element arm branch (e.g., to create multiple frequency resonances to support operations in multiple communications bands) or may have other antenna structures (e.g., parasitic antenna resonating elements, tunable components to support antenna tuning, etc.). For example, resonating element arm 66 may have left and right branches that extend outwardly from antenna feed 44 and return path 68. If desired, multiple feeds may be used to feed antennas such as antenna 40. Resonating element arm 66 may follow any desired path having any desired shape (e.g., curved and/or straight paths, meandering paths, etc.).

If desired, antenna 40 may include one or more adjustable circuits (e.g., tunable components 42 of FIG. 3) that are coupled to resonating element arm 66. As shown in FIG. 5, for example, tunable components such as adjustable inductor 70 may be coupled between antenna resonating element structures in antenna 40 such as resonating element arm 66 and antenna ground 74 (e.g., adjustable inductor 70 may bridge the gap between resonating element arm 66 and antenna ground 74). Adjustable inductor 70 may exhibit an inductance value that is adjusted in response to control signals 72 provided to adjustable inductor 70 from control circuitry 28 (FIG. 3).

Figure 6:
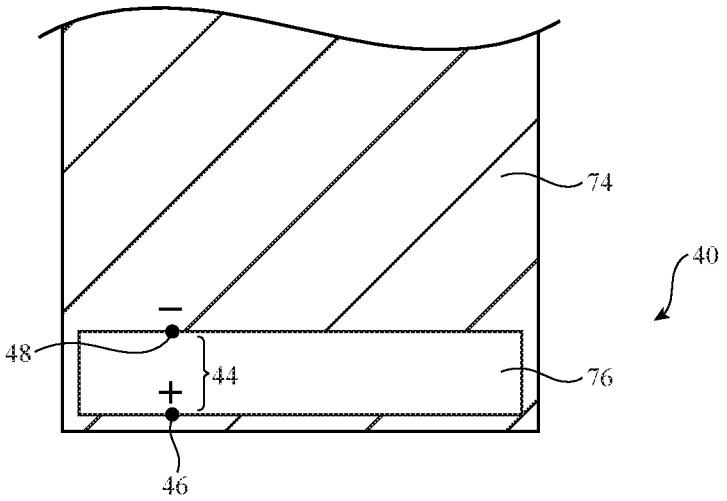
FIG. 6 is a schematic diagram of an illustrative slot antenna in accordance with some embodiments.

Antenna 40 may be a hybrid antenna that includes one or more slot elements. As shown in FIG. 6, for example, antenna 40 may be based on a slot antenna configuration having an opening such as slot 76 that is formed within conductive structures such as antenna ground 74. Slot 76 may be filled with air, plastic, and/or other dielectrics. The shape of slot 76 may be straight or may have one or more bends (e.g., slot 76 may have an elongated shape following a meandering path). Antenna feed terminals 48 and 46 may, for example, be located on opposing sides of slot 76 (e.g., on opposing long sides). Slot 76 may sometimes be referred to herein as slot element 76, slot antenna resonating element 76, slot antenna radiating element 76, or slot radiating element 76. Slot-based radiating elements such as slot 76 of FIG. 6 may give rise to an antenna resonance at frequencies in which the wavelength of the antenna signals is approximately equal to the perimeter of the slot. In narrow slots, the resonant frequency of slot 76 is associated with signal frequencies at which the slot length is approximately equal to a half of a wavelength of operation.

The frequency response of antenna 40 can be tuned using one or more tuning components (e.g., tunable components 42 of FIG. 3). These components may have terminals that are coupled to opposing sides of slot 76 (e.g., the tunable components may bridge slot 76). If desired, tunable components may have terminals that are coupled to respective locations along the length of one of the sides of slot 76. Combinations of these arrangements may also be used. If desired, antenna 40 may be a hybrid slot-inverted-F antenna that includes resonating elements of the type shown in both FIG. 5 and FIG. 6 (e.g., having resonances given by both a resonating element arm such as resonating element arm 66 of FIG. 5 and a slot such as slot 76 of FIG. 6).

The example of FIG. 6 is merely illustrative. In general, slot 76 may have any desired shape (e.g., shapes with straight and/or curved edges), may follow a meandering path, etc. If desired, slot 76 may be an open slot having one or more ends that are free from conductive material (e.g., where slot 76 extends through one or more sides of antenna ground 74). Slot 76 may, for example, have a length approximately equal to one-quarter of the wavelength of operation in these scenarios.

Figure 7:
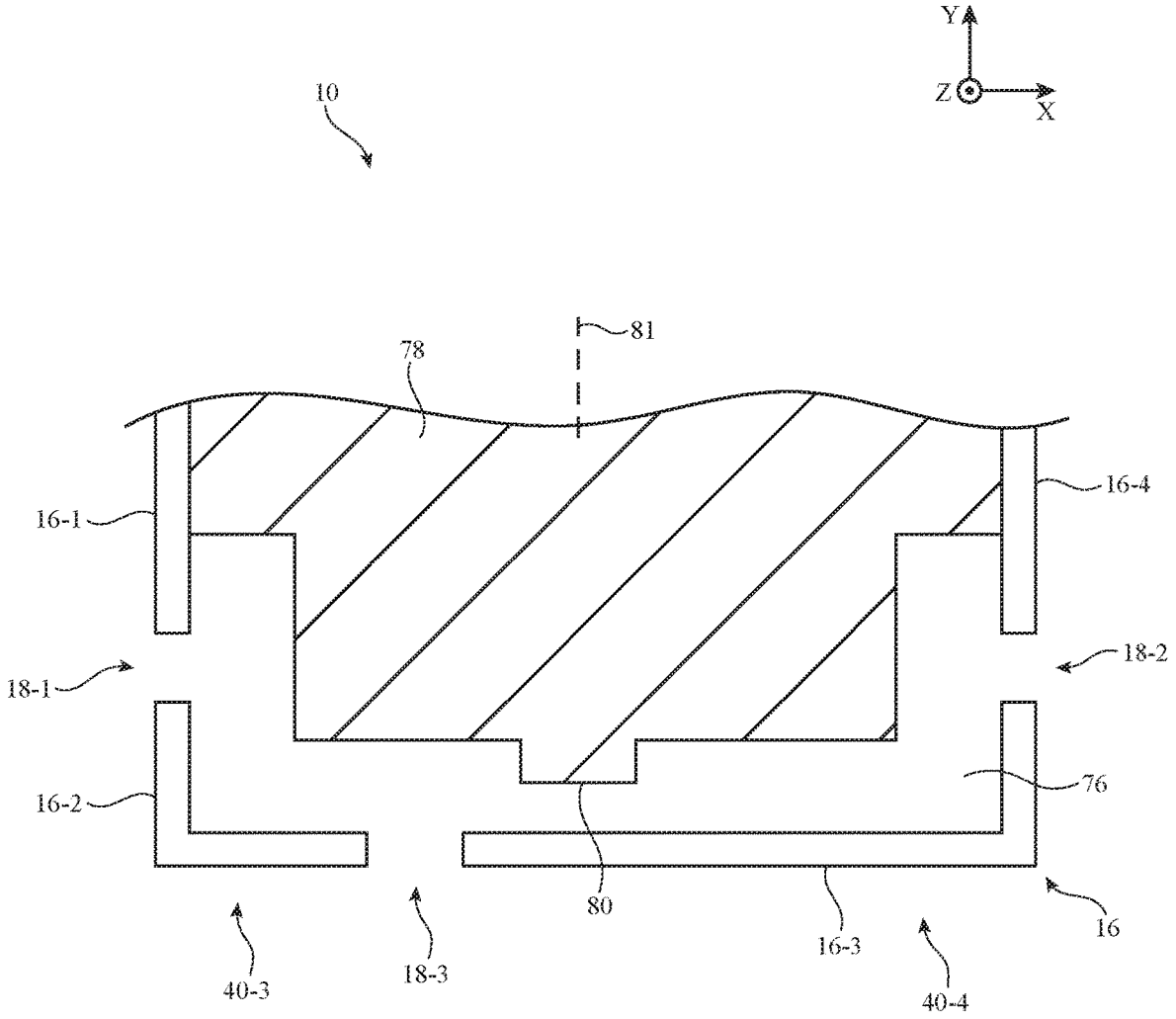
FIG. 7 is a top view of illustrative antennas formed from housing structures in an electronic device in accordance with some embodiments.

A top interior view of an illustrative portion of device 10 that contains antennas 40-4 and 40-3 of FIG. 4 is shown in FIG. 7. In the example of FIG. 7, antennas 40-3 and 40-4 are each formed using hybrid slot-inverted-F antenna structures that includes resonating elements of the types shown in FIGS. 5 and 6.

As shown in FIG. 7, peripheral conductive housing structures 16 may be segmented (divided) by dielectric-filled gaps 18 (e.g., plastic gaps) such as a first gap 18-1, a second gap 18-2, and a third gap 18-3. Each of gaps 18-1, 18-2, and 18-3 may be formed within peripheral structures 16 along respective sides of device 10. For example, gap 18-1 may be formed at a first side of device 10 and may separate a first segment 16-1 of peripheral conductive housing structures 16 from a second segment 16-2 of peripheral conductive housing structures 16. Gap 18-3 may be formed at a second side of device 10 and may separate second segment 16-2 from a third segment 16-3 of peripheral conductive housing structures 16. Gap 18-2 may be formed at a third side of device 10 and may separate third segment 16-3 from a fourth segment 16-4 of peripheral conductive housing structures 16.

The resonating element for antenna 40-4 may include an inverted-F antenna resonating element arm (e.g., resonating element arm 66 of FIG. 5) that is formed from segment 16-3. The resonating element for antenna 40-3 may include an inverted-F antenna resonating element arm that is formed from segment 16-2. Air and/or other dielectric may fill slot 76 between arm segments 16-2 and 16-3 and ground structures 78.

Ground structures 78 may include one or more planar metal layers such as a metal layer used to form a rear housing wall for device 10, a metal layer that forms an internal support structure for device 10, conductive traces on a printed circuit board, and/or any other desired conductive layers in device 10. Ground structures 78 may extend from segment 16-1 to segment 16-4 of peripheral conductive housing structures 16. Ground structures 78 may be coupled to segments 16-1 and 16-4 using conductive adhesive, solder, welds, conductive screws, conductive pins, and/or any other desired conductive interconnect structures. If desired, ground structures 78 and segments 16-1 and 16-4 may be formed from different portions of a single integral conductive structure (e.g., a conductive housing for device 10).

Ground structures 78 need not be confined to a single plane and may, if desired, include multiple layers located in different planes or non-planar structures. Ground structures 78 may include conductive (e.g., grounded) portions of other electrical components within device 10. For example, ground structures 78 may include conductive portions of display 14 (FIG. 1). Conductive portions of display 14 may include a metal frame for display 14, a metal backplate for display 14, shielding layers or shielding cans for display 14, pixel circuitry in display 14, touch sensor circuitry (e.g., touch sensor electrodes) for display 14, and/or any other desired conductive structures in display 14 or used for mounting display 14 to the housing for device 10.

Ground structures 78 and segments 16-1 and 16-4 may form portions of antenna ground 74 (FIGS. 5 and 6) for antennas 40-3 and 40-4. If desired, slot 76 may be configured to form slot antenna resonating element structures that contribute to the overall performance of antennas 40-3 and/or 40-4. Slot 76 may extend from gap 18-1 to gap 18-2 (e.g., the ends of slot 76 which may sometimes be referred to as open ends, may be formed by gaps 18-1 and 18-2). Slot 76 may have an elongated shape having any suitable length (e.g., about 4-20 cm, more than 2 cm, more than 4 cm, more than 8 cm, more than 12 cm, less than 25 cm, less than 10 cm, etc.) and any suitable width (e.g., approximately 2 mm, less than 2 mm, less than 3 mm, less than 4 mm, 1-3 mm, etc.). Gap 18-3 may be continuous with and extend perpendicular to a portion of slot 76 along the longitudinal axis of the longest portion of slot 76 (e.g., the portion of slot 76 extending parallel to the X-axis of FIG. 7). If desired, slot 76 may include vertical portions that extend parallel to longitudinal axis 81 (e.g., the Y-axis of FIG. 7) and beyond gaps 18-1 and 18-2.

As shown in FIG. 7, a portion 80 of ground structures 78 may protrude into slot 76 towards segment 16-3. Portion 80 of ground structures 78 (sometimes referred to herein as protrusion 80, ground protrusion 80, extension 80, or ground extension 80) may be located closer to segment 16-3 than other portions of ground structures 78 (e.g., ground extension 80 may extend parallel to longitudinal axis 81 towards segment 16-3). Ground extension 80 may, for example, support components for display 14 of FIG. 1 (e.g., components that allow active area AA of display 14 to extend across substantially all of the front face of device 10). If desired, ground extension 80 may form a distributed capacitance with segment 16-3 that tunes the frequency response of antenna 40-4.

Slot 76 may be filled with dielectric such as air, plastic, ceramic, or glass. For example, plastic may be inserted into portions of slot 76 and this plastic may be flush with the exterior of the housing for device 10. Dielectric material in slot 76 may lie flush with dielectric material in gaps 18-1, 18-2, and 18-3 at the exterior of the housing 12 if desired. The example of FIG. 7 in which slot 76 has a U-shape is merely illustrative. If desired, slot 76 may have any other desired shapes (e.g., a rectangular shape, meandering shapes having curved and/or straight edges, etc.).

In general, it may be desirable to support multiple frequency bands using antenna 40-4 (e.g., using a MIMO scheme with the other antennas in device 10 to maximize the data rate for wireless communications circuitry 34 of FIG. 2). For example, antenna 40-4 may support communications in a cellular low band, a cellular low-midband, a cellular high band, and/or a cellular ultra-high band. In order to support operations at multiple frequency bands with satisfactory antenna efficiency, antenna 40-4 may be provided with multiple positive antenna feed terminals such as positive antenna feed terminal 46 of FIGS. 3, 5, and 6. The positive antenna feed terminals may be located at different points along segments 16-3 and 16-4, for example.

Figure 8:
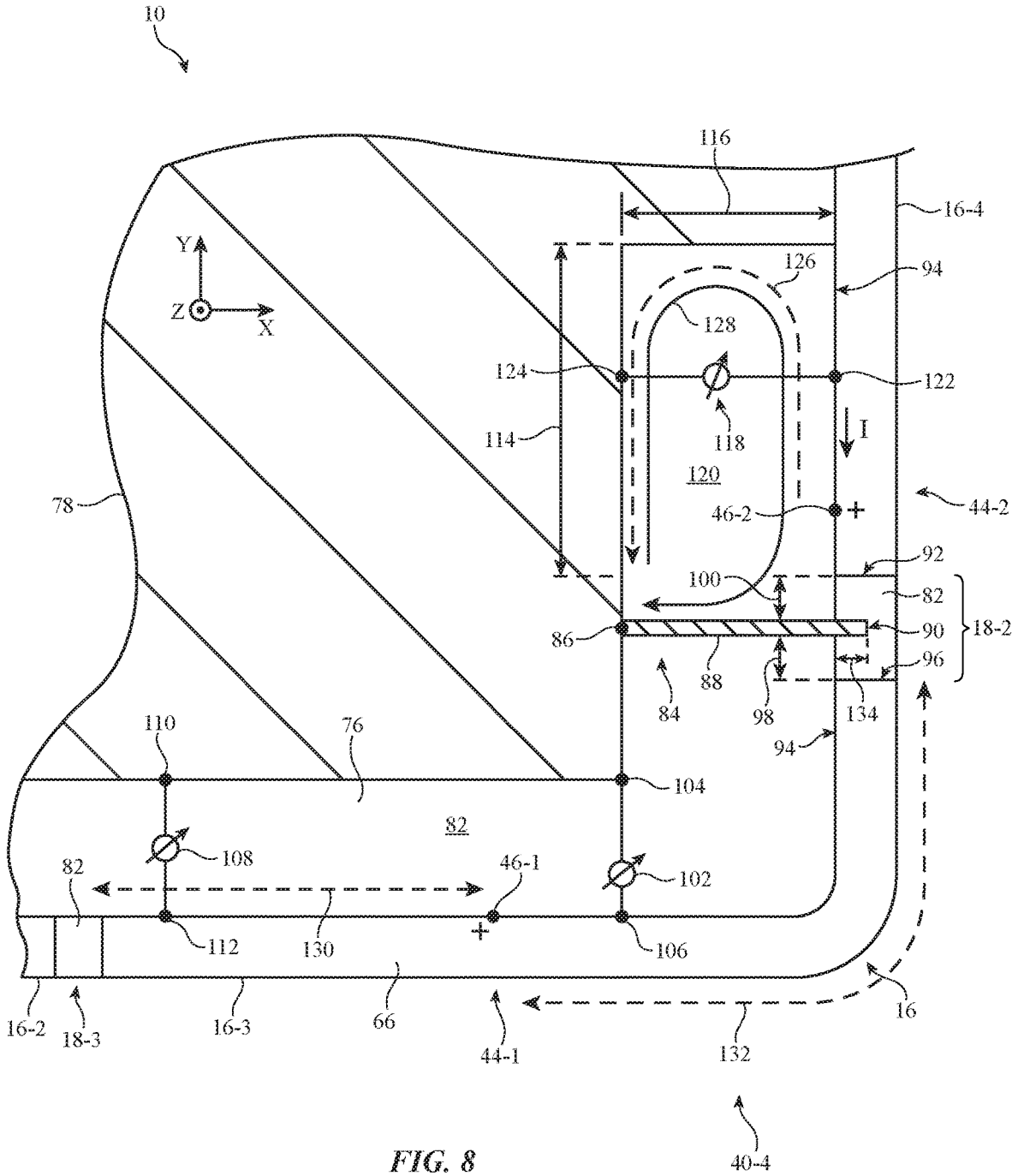
FIG. 8 is a top view of an illustrative antenna having multiple positive antenna feed terminals and an isolation element coupled between slot elements for optimizing radio-frequency performance across multiple different communications bands in accordance with some embodiments.

FIG. 8 is a top interior view of an illustrative portion of device 10 that contains antenna 40-4. Antenna 40-4 of FIG. 8 may, for example, support wireless communications with satisfactory antenna efficiency across multiple frequency bands of interest.

As shown in FIG. 8, antenna 40-4 may be formed at a corner of device 10 and may include an antenna resonating element arm 66 formed from segment 16-3 of peripheral conductive housing structures 16. Antenna 40-4 may be fed using multiple antenna feeds such as a first antenna feed 44-1 having a first positive antenna feed terminal 46-1 coupled to segment 16-3 and a second antenna feed 44-2 having a second positive antenna feed terminal 46-2 coupled to segment 16-4. The ground antenna feed terminals for first antenna feed 44-1 and second antenna feed 44-2 may be coupled to ground structures 78, but are omitted from FIG. 8 for the sake of clarity.

Ground structures 78 may have any desired shape within device 10. For example, the lower edge of ground structures 78 (e.g., the edge of ground structures 78 defining the upper edge of slot 76) may be aligned with gap 18-2 in peripheral conductive housing structures 16 (e.g., upper edge 92 or lower edge 96 of gap 18-2 may be aligned with the edge of ground structures 78 defining the portion of slot 76 adjacent to gap 18-2). If desired, as shown in the example of FIG. 8, ground structures 78 may include a slot such as vertical slot 120 adjacent to gap 18-2 that extends above upper edge 92 of gap 18-2 (e.g., in the direction of the Y-axis of FIG. 8). Vertical slot 120 may, for example, have two or more edges that are defined by ground structures 78 and one edge that is defined by segment 16-4 of the peripheral conductive housing structures. Vertical slot 120 may have an open end defined by an open end of slot 76 at gap 18-2 and an opposing closed end defined by ground structures 78. Vertical slot 120 may therefore sometimes be referred to herein as a continuous portion of slot 76, a vertical portion of slot 76, or a vertical extension of slot 76.

Vertical slot 120 may have a width 116 that separates ground structures 78 from segment 16-4 of peripheral conductive structures 16 (e.g., in the direction of the X-axis of FIG. 7). Vertical slot 120 may have any desired width 116 (e.g., about 2 mm, less than 4 mm, less than 3 mm, less than 2 mm, less than 1 mm, more than 0.5 mm, more than 1.5 mm, more than 2.5 mm, 1-3 mm, etc.). Vertical slot 120 may have an elongated length 114 (e.g., perpendicular to width 116). Length 114 may be, for example, 10-15 mm, more than 5 mm, more than 10 mm, more than 15 mm, more than 30 mm, less than 30 mm, less than 20 mm, less than 15 mm, less than 10 mm, between 5 and 20 mm, etc.

Portions of vertical slot 120 may contribute slot antenna resonances to antenna 40-4 in one or more frequency bands if desired. For example, length 114 and width 116 of vertical slot 120 (e.g., the perimeter of vertical slot 120 shown by dashed path 126) may be selected so that antenna 40-4 resonates at desired operating frequencies. If desired, the overall length of slots 76 and 120 may be selected so that antenna 40-4 resonates at desired operating frequencies.

Antenna 40-4 may include adjustable components 108, 102, and 118 (e.g., tunable components 42 of FIG. 3). Adjustable component 108 may have a first terminal 110 coupled to ground structures 78 and a second terminal 112 coupled to segment 16-3 (e.g., adjustable component 108 may be coupled across slot 76). Adjustable component 102 may have a first terminal 104 coupled to ground structures 78 and a second terminal 106 coupled to segment 16-3 (e.g., adjustable component 102 may be coupled across slot 76). Adjustable component 118 may have a first terminal 124 coupled to ground structures 78 and a second terminal 122 coupled to segment 16-3 (e.g., adjustable component 118 may be coupled across vertical slot 120). Positive antenna feed terminal 46-2 may be interposed on segment 16-4 between terminal 122 and gap 18-2. Positive antenna feed terminal 46-1 may be interposed on segment 16-3 between terminals 112 and 106. Terminal 106 may be interposed on segment 16-3 between positive antenna feed terminal 46-1 and gap 18-2. Terminal 112 may be interposed on segment 16-3 between positive antenna feed terminal 46-1 and gap 18-3. These examples are merely illustrative and, if desired, these terminals may be arranged in any desired order. Return paths for antenna 40-4 such as return path 68 of FIG. 5 may be formed by adjustable components 108, 102, and/or 118.

Adjustable components 108, 102, and 118 may each include switches coupled to fixed components such as inductors for providing adjustable amounts of inductance, a short circuit path, and/or an open circuit between peripheral conductive housing structures 16 and ground structures 78. If desired, adjustable components 108, 102, and 118 may also or alternatively include fixed components that are not coupled to switches or a combination of components that are coupled to switches and components that are not coupled to switches. These examples are merely illustrative and, in general, components 108, 102, and 118 may include other components such as adjustable return path switches, switches coupled to capacitors, or any other desired components.

The length of resonating element arm 66 (and the perimeter of vertical slot 120) may be selected so that antenna

40-4 radiates at desired operating frequencies such as frequencies in a cellular low band (e.g., a frequency band between about 600 MHz and 960 MHz), a cellular low-midband (e.g., a frequency band between about 1410 MHz and 1510 MHz), a cellular midband (e.g., a frequency band between about 1710 MHz and 2170 MHz), and/or a cellular ultra-high band (e.g., a frequency band between about 3300 MHz and 5000 MHz).

Positive antenna feed terminal 46-1 may be used to convey radio-frequency signals in the cellular low band as well as signals at frequencies higher than the cellular low band. For example, the length of resonating element arm 66 extending from positive antenna feed terminal 46-1 to gap 18-2, as shown by dashed path 132, may be selected to cover frequencies in the cellular low-midband and/or the cellular midband. This length may be approximately equal to one-quarter of the wavelength corresponding to a frequency in one of these frequency bands (e.g., where the wavelength is an effective wavelength that accounts for dielectric loading by the dielectric materials in slot 76). If desired, adjustable component 102 may be adjusted to tune the frequency response associated with dashed path 132 between the cellular low-midband and the cellular midband (e.g., adjustable component 102 may have a first state at which antenna 40-4 covers the cellular midband and a second state at which antenna 40-4 covers the cellular low-midband). At the same time, the length of resonating element arm 66 extending from positive antenna feed terminal 46-1 to gap 18-3, as shown by dashed path 130, may be selected to cover frequencies in the cellular low band. This length may be approximately equal to one-quarter of the wavelength corresponding to a frequency in the cellular low band (e.g., where the wavelength is an effective wavelength that accounts for dielectric loading by the dielectric materials in slot 76). If desired, adjustable component 108 may be adjusted to tune the frequency response associated with dashed path 130 within the cellular low band.

Segment 16-4 of peripheral conductive housing structures 16 and the portion of ground structures 78 surrounding vertical slot 120 may contribute to the frequency response of antenna 40-4 in the cellular high band and/or the cellular ultra-high band. For example, the perimeter of vertical slot 120, as shown by dashed path 126, may be selected so that vertical slot 120 radiates in the cellular high band and/or the cellular ultra-high band. Positive antenna feed terminal 46-2 may be used to convey radio-frequency signals in the cellular high band and/or the cellular ultra-high band using vertical slot 120. If desired, adjustable component 118 may be adjusted to tune the frequency response associated with vertical slot 120 (e.g., within the cellular high band and the cellular ultra-high band or between the cellular high band and the cellular ultra-high band).

Antenna 40-4 may concurrently convey radio-frequency signals in some or all of the cellular low band, the cellular low-midband, the cellular midband, the cellular high band, and the cellular ultra-high band using positive antenna feed terminals 46-1 and 46-2. For example, positive antenna feed terminal 46-1, segment 16-3, and slot 76 may convey radio-frequency signals in the cellular low band, the cellular low-midband, and/or the cellular midband while positive antenna feed terminal 46-2, and vertical slot 120 concurrently convey radio-frequency signals in the cellular high band and/or the cellular ultra-high band. However, if care is not taken, radio-frequency signals conveyed by vertical slot 120 in the cellular high band may electromagnetically interfere with radio-frequency signals conveyed by segment 16-3 and slot 76 in the cellular midband, thereby limiting the radio-frequency performance of antenna 40-4.

In order to optimize isolation between vertical slot 120 and segment 16-3 (e.g., to allow for concurrent communications in the cellular midband and the cellular high band with satisfactory antenna efficiency), antenna 40-4 may include an antenna isolation element such as isolation element 84. Isolation element 84 may separate slot 76 from vertical slot 120 and may include a conductive strip such as metal strip 88. Metal strip 88 may have a grounded end coupled to ground structures 78 at terminal 86 and an opposing (floating) tip 90. Tip 90 may be located within gap 18-2 (e.g., tip 90 may be interposed between upper edge 92 and lower edge 96 of gap 18-2).

Isolation element 84 (e.g., the dimensions of metal strip 88) may be configured to optimize radio-frequency performance within the cellular high band and/or the cellular ultra-high band for vertical slot 120 while also maximizing isolation between radiation by vertical slot 120 in the cellular high band and radiation by segment 16-3 and slot 76 in the cellular midband. For example, tip 90 of metal strip 88 may extend into gap 18-2 by distance 134 (e.g., tip 90 may extend beyond interior surface 94 of segment 16-3 by distance 134). Metal strip 88 may be separated from upper edge 92 of gap 18-2 by distance 100 and may be separated from lower edge 98 of gap 18-2 by distance 98. Distances 134, 100, and/or 98 may be selected to maximize isolation between vertical slot 120 and segment 16-3 while also tuning the frequency response of vertical slot 120.

For example, distances 100 and/or 134 may be adjusted to vary the capacitive coupling between metal strip 88 and segment 16-4 and to thereby tune the frequency response of vertical slot 120 (e.g., greater distances 134 and lesser distances 100 may be associated with increased capacitive coupling between metal strip 88 and segment 16-4). Positive antenna feed terminal 46-2 may convey antenna currents I at frequencies in the cellular high band and the cellular ultra-high band. Metal strip 88 may form a (short) circuit path to ground structures 78 for antenna currents I, allowing antenna currents I to flow from positive antenna feed terminal 46-2 to terminal 86 on ground structures 78 through metal strip 88. In this way, metal strip 88 may contribute to the resonance of vertical slot 120 and antenna currents I may follow a closed-loop path around vertical slot 120, as shown by path 128. The length of path 128 may be selected to tune the frequency response of vertical slot 120 in the cellular high band and/or the cellular ultra-high band.

At the same time, distances 98 and/or 134 may be selected to maximize electromagnetic isolation between vertical slot 120 and segment 16-3 (slot 76). For example, while antenna currents I in the cellular high band and cellular ultra-high band flow across distance 100 between segment 16-4 and metal strip 88, segment 16-3 conveys antenna currents for positive antenna feed terminal 46-1 at lower frequencies such as frequencies in the cellular midband. Distances 98 and/or 134 may be selected so that these lower-frequency antenna currents in the cellular midband encounter an open circuit (e.g., infinite) impedance between lower edge 96 of gap 18-2 and metal strip 88. This may serve to electromagnetically isolate the radio-frequency signals conveyed by segment 16-3 and slot 76 in the cellular midband from the radio-frequency signals conveyed by segment 16-4 and vertical slot 120 in the cellular high band. This may in turn allow antenna 40-4 to concurrently convey radio-frequency signals in both the cellular midband and the cellular high band with satisfactory antenna efficiency.

Metal strip 88 may be formed from an integral portion of ground structures 78 (e.g., an integral extension of ground structures 78), from sheet metal, from conductive traces, metal foil or sheet metal on an underlying dielectric substrate, or from any other desired conductive structures. In one suitable arrangement that is sometimes described herein as an example, metal strip 88 may be formed from conductive traces patterned onto dielectric 82 within slot 76. Dielectric 82 may be formed from a single piece of plastic, ceramic, or other dielectric material that fills slot 76, vertical slot 120, gap 18-2, and gap 18-3. Metal strip 88 may be formed from conductive traces on dielectric 82 at the interior of device 10. In another suitable arrangement, some or all of metal strip 88 may be embedded within dielectric 82 (e.g., some or all of metal strip 88 may be molded within dielectric 82, which may be formed from one or more shots of injection molded plastic, as one example). This is merely illustrative and, if desired, separate dielectric substrates may be formed in each of these components. Terminal 86 of isolation element 84 may couple metal strip 88 to ground traces and/or a conductive support plate for device 10 in ground structures 78. If desired, metal strip 88 may also be coupled to conductive portions of the display for device 10 (e.g., display 14 of FIG. 1) at terminal 86.

Figure 9:
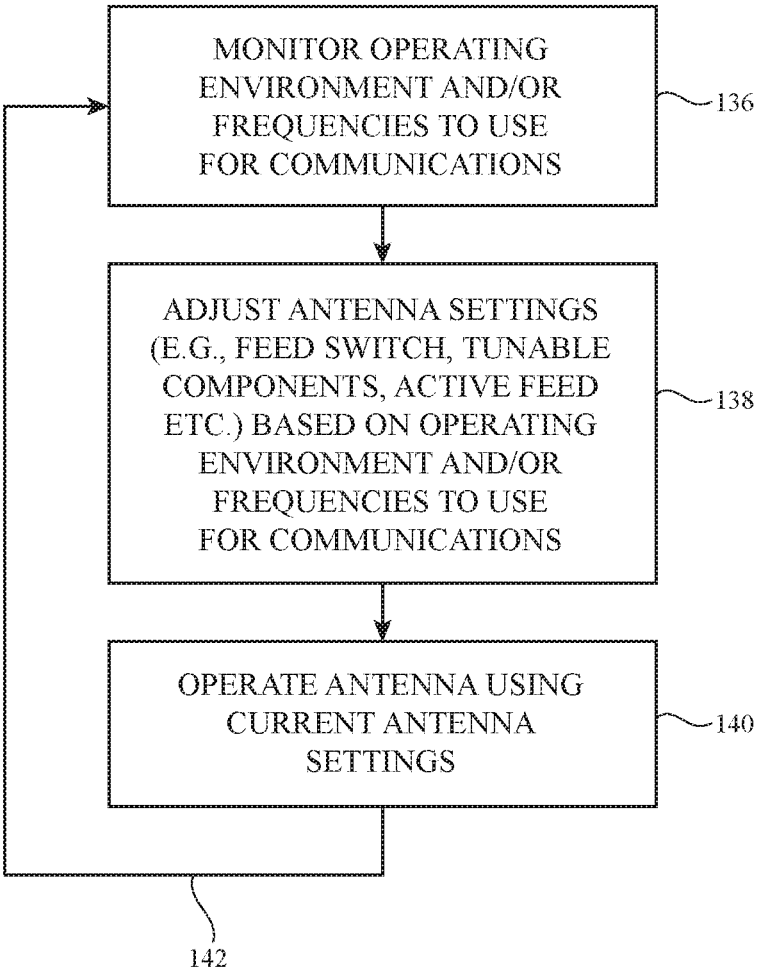
FIG. 9 is a flow chart of illustrative steps that may be involved in adjusting an antenna of the type shown in FIG. 8 in accordance with some embodiments.

FIG. 9 is a flow chart of illustrative steps involved in operating device 10 to ensure satisfactory performance for antenna 40-4 of FIG. 8 in all desired frequency bands of interest.

At step 136 of FIG. 9, control circuitry 28 (FIG. 3) may monitor the operating environment of device 10 and/or frequencies to use for performing wireless communications. The frequencies to use may be determined based on software running on control circuitry 28 (e.g., software controlling wireless communications for device 10) and/or based on an assignment received from external equipment like a wireless base station.

Control circuitry 28 may, in general, use any suitable type of sensor measurements, wireless signal measurements, operation information, or antenna measurements to determine how device 10 is being used (e.g., to determine the operating environment of device 10). For example, control circuitry 28 may use sensors such as temperature sensors, capacitive proximity sensors, light-based proximity sensors, resistance sensors, force sensors, touch sensors, connector sensors that sense the presence of a connector in a connector port or that detect the presence or absence of data transmission through a connector port, sensors that detect whether wired or wireless headphones are being used with device 10, sensors that identify a type of headphone or accessory device that is being used with device 10 (e.g., sensors that identify an accessory identifier identifying an accessory that is being used with device 10), or other sensors to determine how device 10 is being used. Control circuitry 28 may also use information from an orientation sensor such as an accelerometer in device 10 to help determine whether device 10 is being held in a position characteristic of right hand use or left hand use (or is being operated in free space). Control circuitry 28 may also use information about a usage scenario of device 10 in determining how device 10 is being used (e.g., information identifying whether audio data is being transmitted through speaker port 24 of FIG. 1, information identifying whether a telephone call is being conducted, information identifying whether a microphone on device 10 is receiving voice signals, etc.).

If desired, an impedance sensor or other sensor may be used in monitoring the impedance of antenna 40-4 or part of antenna 40-4. Different antenna loading scenarios may load antenna 40-4 differently, so impedance measurements may help determine whether device 10 is being gripped by a user's left or right hand or is being operated in free space. Another way in which control circuitry 28 may monitor antenna loading conditions involves making received signal strength measurements on radio-frequency signals being received with antenna 40-4. In this example, the adjustable circuitry of antenna 40-4 can be toggled between different settings and an optimum setting for antenna 40-4 can be identified by choosing a setting that maximizes received signal strength. In general, any desired combinations of one or more of these measurements or other measurements may be processed by control circuitry 28 to identify how device 10 is being used (i.e., to identify the operating environment of device 10).

At step 134, control circuitry 28 may adjust the configuration of antenna 40-4 (e.g., antenna settings for antenna 40-4) based on the current operating environment of device 10 and/or the frequencies to use for communications (e.g., based on data or information gathered while processing step 136). Control circuitry 28 may adjust components 108, 102, and/or 118 to adjust the frequency response of antenna 40-4 based on the information gathered while processing step 136 of FIG. 9.

At step 140, antenna 40-4 may be used to transmit and receive wireless data using the antenna settings selected at step 138. This process may be performed continuously, as indicated by path 142. In this way, antenna 40-4 may be dynamically adjusted in real time based on the operating environment and needs of device 10. Similar steps may be used to adjust antennas 40-1, 40-2, 40-3, and/or other antennas 40 in device 10 if desired.

Figure 10:
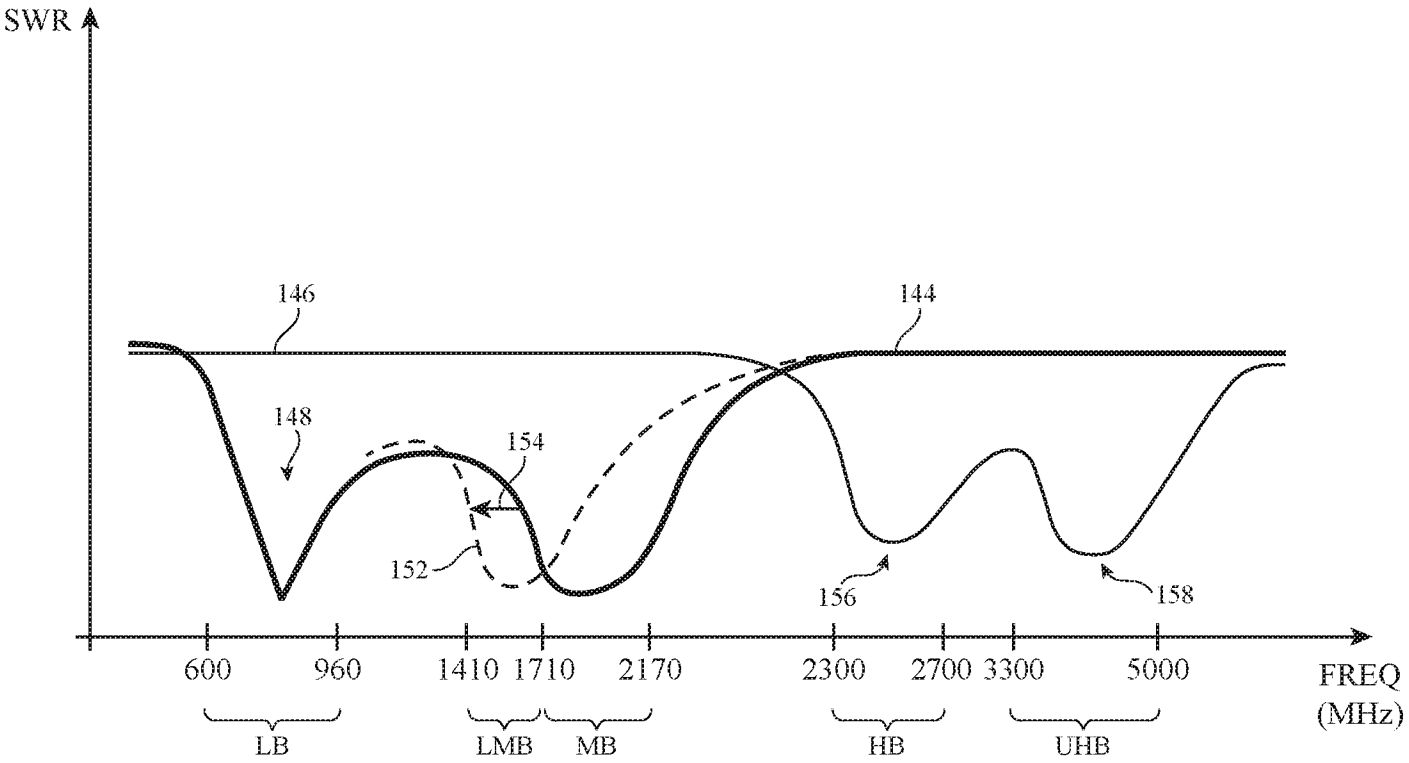
FIG. 10 is a plot of antenna performance (standing wave ratio) of an illustrative antenna of the type shown in FIG. 8 in accordance with some embodiments.

FIG. 10 is a graph in which antenna performance (standing wave ratio) has been plotted as a function of operating frequency for antenna 40-4 of FIG. 8. As shown in FIG. 10, curve 146 plots an exemplary frequency response of vertical slot 120 (e.g., for radio-frequency signals conveyed over positive antenna feed terminal 46-2 of FIG. 8). As shown by curve 146, vertical slot 120 may exhibit a first response peak 156 in cellular high band HB (e.g., frequencies from 2300 MHz to 2700 MHz) and a second response peak 158 in cellular ultra-high band UHB (e.g., frequencies from 3300 MHz to 5000 MHz). Response peaks 156 and 158 may be associated with the perimeter of vertical slot 120, as modified by the capacitance introduced by metal strip 88 (e.g., response peaks 156 and 158 may be supported by path 128 of FIG. 8). Adjustable component 118 may be adjusted to tune the frequency response of antenna 40-4 within cellular high band HB and cellular ultra-high band UHB or to tune the frequency response of antenna 40-4 between cellular high band HB and cellular ultra-high band UHB (e.g., in scenarios where antenna 40-4 only covers one of bands HB and UHB at any given time).

Curve 144 of FIG. 10 plots an exemplary frequency response of slot 76 and segment 16-3 of FIG. 8. As shown by curve 144, slot 76 and segment 16-3 (e.g., the portion of segment 16-3 associated with dashed path 130 of FIG. 8) may exhibit a first response peak 148 in cellular low band LB (e.g., frequencies from 600 MHz to 960 MHz). Slot 76 and segment 16-3 (e.g., the portion of segment 16-3 associated with dashed path 132 of FIG. 8) may exhibit a second response peak 150 in cellular midband MB (e.g., frequencies from 1710 MHz to 2170 MHz). If desired, adjustable component 102 may be adjusted to pull response peak 150 to lower frequencies, as shown by arrow 154. This may configure antenna 40-4 to exhibit response peak 152 instead of response peak 150, allowing antenna 40-4 to cover cellular low-midband LMB (e.g., frequencies from 1410 MHz to 1510 MHz). In the absence of isolation element 84 of FIG. 8, antenna 40-4 may be incapable of supporting both response peaks 150 and 156 at the same time with satisfactory antenna efficiency (e.g., due to electromagnetic interference between the operation of vertical slot 120 in cellular high band HB and the operation of segment 16-3 and slot 76 in cellular midband MB). The presence of isolation element 84 may tune the frequency response of antenna 40-4 within cellular high band HB and/or cellular ultra-high band UHB while also providing sufficient electromagnetic isolation between vertical slot 120 and segment 16-3. This may allow antenna 40-4 to convey radio-frequency signals in cellular midband MB using positive antenna feed terminal 46-1 of FIG. 8 concurrently with conveying radio-frequency signals in cellular high band HB using positive antenna feed terminal 46-2 of FIG. 8 (e.g., while allowing for satisfactory antenna efficiency in both cellular high band HB and cellular midband MB).

The example of FIG. 10 is merely illustrative. In general, antenna 40-4 may cover any desired bands at any desired frequencies (e.g., antenna 40-4 may exhibit any desired number of efficiency peaks extending over any desired frequency bands). Curves 146 and 144 may have other shapes if desired.

In this way, device 10 may be provided with a display 14 (FIG. 1) having an active area AA that extends across substantially all of the front face of device 10. Antenna 40-4 may be provided with satisfactory antenna efficiency across multiple frequency bands of interest despite the presence of the conductive display structures used to support such a large active area AA for display 14. Antenna 40-4 may operate using a carrier aggregation scheme across one or more of these frequency bands and using a MIMO scheme with the other antennas in device 10 to maximize wireless data throughput for device 10.

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

ground structures;

a housing having peripheral conductive housing structures;

a dielectric gap that divides the peripheral conductive housing structures into first and second segments, the first segment being separated from the ground structures by a first slot element and the second segment being separated from the ground structures by a second slot element;

a first positive antenna feed terminal coupled to the first segment, the first positive antenna feed terminal and the first segment being configured to convey first radio-frequency signals in a first frequency band;

a second positive antenna feed terminal coupled to the second segment, the second positive antenna feed terminal and the second slot element being configured to convey second radio-frequency signals in a second frequency band that is different from the first frequency band; and an isolation element that is coupled to the ground structures and that separates the first slot element from the second slot element, wherein the isolation element is configured to isolate the first radio-frequency signals in the first frequency band from the second radio-frequency signals in the second frequency band.

2. The electronic device defined in claim 1, wherein the second positive antenna feed terminal is configured to convey antenna currents in the second frequency band, the antenna currents being configured to flow from the second segment to the antenna ground across a portion of the dielectric gap and through the isolation element.

3. The electronic device defined in claim 2, wherein the isolation element is configured to form an open circuit impedance across the dielectric gap in the first frequency band.

4. The electronic device defined in claim 1, wherein the isolation element comprises a metal strip having a tip within the dielectric gap, the tip being interposed between the first and second segments.

5. The electronic device defined in claim 4, further comprising:

a dielectric, wherein the metal strip comprises a conductive trace on the dielectric.

6. The electronic device defined in claim 5, wherein the dielectric fills the first and second slot elements and the dielectric gap.

7. The electronic device defined in claim 4, further comprising:

a dielectric, wherein the metal strip is embedded in the dielectric.

8. The electronic device defined in claim 1, further comprising:

a first adjustable component coupled between the first segment and the ground structures across the first slot element, the first adjustable component being configured to tune the first frequency band; and a second adjustable component coupled between the second segment and the ground structures across the second slot element, the second adjustable component being configured to tune the second frequency band.

9. The electronic device defined in claim 1, wherein the second frequency band is higher than the first frequency band and the second slot element is further configured to convey the second radio-frequency signals in a third frequency band that is higher than the second frequency band.

10. The electronic device defined in claim 9, wherein the first segment is further configured to convey the first radio-frequency signals in a fourth frequency band that is lower than the first frequency band.

11. The electronic device defined in claim 10, wherein the first frequency band comprises a frequency between 1710 MHz and 2170 MHz, the second frequency band comprises a frequency between 2300 MHz and 2700 MHz, the third frequency band comprises a frequency between 3300 MHz and 5000 MHz, and the fourth frequency band comprises a frequency between 600 MHz and 960 MHz.

12. The electronic device defined in claim 1, wherein the second slot element is configured to convey the second radio-frequency signals while the first segment conveys the first radio-frequency signals.

13. An electronic device comprising:

an antenna ground;

peripheral conductive housing structures;

a dielectric gap in the peripheral conductive housing structures, wherein the dielectric gap separates a first segment of the peripheral conductive housing structures from a second segment of the peripheral conductive housing structures;

a first slot element between the first segment and the antenna ground;

a second slot element between the second segment and the antenna ground;

a first antenna feed coupled across the first slot element;

a second antenna feed coupled across the second slot element; and a metal strip having an end and a tip, wherein the end is coupled to the antenna ground and the tip is located within the dielectric gap and interposed between the first and second segments.

14. The electronic device defined in claim 13, wherein the first segment and the first antenna feed are configured to convey first radio-frequency signals in a first frequency band, the second slot element and the second antenna feed being configured to convey second radio-frequency signals in a second frequency band that is higher than the first frequency band.

15. The electronic device define din claim 14, wherein antenna currents corresponding to the second radio-frequency signals flow along a loop path that runs around the second slot element and that includes a portion of the antenna ground, the second segment, and the metal strip.

16. The electronic device defined in claim 15, wherein the antenna currents flow from the second segment to the tip across a portion of the dielectric gap and from the tip to the antenna ground through the metal strip.

17. The electronic device defined in claim 16, wherein the tip extends into the dielectric gap by a first distance with respect to an interior surface of the first segment, the tip is separated from the second segment by a second distance, and the first and second distances are selected to interpose a tuning capacitance on the loop path that tunes a frequency response of the second slot element.

18. The electronic device defined in claim 17, wherein the metal strip is configured to form an open circuit impedance between the tip and the first segment in the first frequency band.

19. An antenna comprising:

ground structures;

a first conductive segment that is separated from the ground structures by a first slot element;

a second conductive segment that is separated from the ground structures by a second slot element and that is separated from the first conductive segment by a dielectric gap;

a metal strip having a first end coupled to the ground structures and an opposing second end that extends into the dielectric gap;

a first positive antenna feed terminal coupled to the first conductive segment, wherein the first positive antenna feed terminal is configured to convey first radio-frequency signals in a first frequency band, the metal strip being configured to form an open circuit impedance between the second end of the metal strip and the first conductive segment in the first frequency band; and a second positive antenna feed terminal coupled to the second conductive segment, the second positive antenna feed terminal being configured to convey second radio-frequency signals in a second frequency band that is higher than the first frequency band, wherein antenna currents corresponding to the second radio-frequency signals flow along a conductive loop path that includes the second conductive segment, the metal strip, and a portion of the antenna ground.

20. The antenna defined in claim 19, wherein the antenna currents flow between the second segment and the second end of the metal strip across a portion of the dielectric gap.

* * * * *